US005567134A

United States Patent [19]

Inoue

[11] Patent Number: 5,567,134

[45] Date of Patent: Oct. 22, 1996

[54] HIGH-PRESSURE FUEL-FEED PUMP

[75] Inventor: Hiroshi Inoue, Chiryu, Japan

[73] Assignee: Nippondenso Co., Ltd., Kariya, Japan

[21] Appl. No.: 494,180

[22] Filed: Jun. 23, 1995

[30] Foreign Application Priority Data

Jun. 24, 1994 [JP] Japan ..... 6-143626

[51] Int. Cl.[6] ..... F02M 59/44; F02D 1/02

[52] U.S. Cl. ..... 417/490

[58] Field of Search ..... 417/289, 490, 417/498

[56] References Cited

FOREIGN PATENT DOCUMENTS

| | | |
|---|---|---|
| 0057674 | 8/1982 | European Pat. Off. . |
| 56-90469 | 7/1981 | Japan . |
| 57-193970 | 12/1982 | Japan . |
| 59-43961 | 3/1984 | Japan . |
| 3-6058 | 1/1991 | Japan . |
| 04-353262 | 12/1992 | Japan . |
| 4353262 | 12/1992 | Japan . |
| 5-99097 | 4/1993 | Japan . |
| 05-180115 | 7/1993 | Japan . |
| 1585439 | 3/1981 | United Kingdom . |

*Primary Examiner*—Richard E. Gluck
*Attorney, Agent, or Firm*—Cushman, Darby & Cushman

[57] ABSTRACT

A protruding portion is formed integrally on a lower portion of a cylinder so as to protrude from the cylinder. A seal member has a tubular shape with an end. A hole is disposed at the end. Around the hole, a lip portion made of resilient material is disposed. The seal member is mated to an outer peripheral wall of the protruding portion by press-fitting. The lip portion can thin a fuel-oil film covering an outer peripheral wall of a plunger. The amount of leakage of fuel or oil is reduced. Because the protruding portion can be formed compactly and of thick plate thickness by press-fitting the seal member into the protruding portion formed integrally with the cylinder, deformation during heat treatment of the cylinder can be reduced, and along with the, machining of a sliding hole becomes simple.

14 Claims, 17 Drawing Sheets

HIGH-PRESSURE FUEL-FEED PUMP

BACKGROUND OF THE INVENTION

1. Field of the Invention

The present invention relates to a high-pressure fuel-feed pump employed in an internal combustion engine ("internal combustion engine" will hereinafter be termed "engine").

2. Description of the Related Art

A high-pressure fuel-feed pump of plunger-pump type according to the related art and employed in a fuel system of a gasoline engine is indicated in FIG. 26. A fuel pump 302 is housed in a fuel tank 301, and after fuel is pressurized at several hundred kpa by the fuel pump 302, it is sent under pressure to an intake port 304 on a fuel filter 303. A discharge port 305 on the fuel filter 303 is connected to an intake port 307 on a high-pressure fuel-feed pump 306. Drive force due to reciprocating motion of a piston 311 is conveyed to a camshaft 310 by an interconnecting mechanism composed of a connected rod 312, crankshaft 313, and belt 314, causing to rotate the camshaft 310 of the high-pressure fuel-feed pump 306. Fuel taken in from the intake port 307 is pressurized to a high pressure of from several Mpa to several tens of Mpa by the high-pressure fuel-feed pump 306, and is discharged via a discharge port 308 to a common rail 309. High-pressure fuel which has collected pressure in the common rail 309 is supplied via a branching passage 315 to injectors 317 provided in several cylinders of the engine. Accordingly, high-pressure fuel from the injectors 317 is sprayed directly into combustion chambers 316 within the cylinders.

Excess low-pressure fuel output from a bypass discharge port 318 of the high-pressure fuel-feed pump 306 is returned via a return passage 319 to the fuel tank 303. Within the common rail 309 is disposed a pressure sensor 320 to detect the pressure of fuel in the interior thereof, and the pressure signal detected by the pressure sensor 320 is input to an electronic control unit 321. The electronic control unit 321 controls the conductance timing of a solenoid valve 322 in accordance with the pressure signal detected by the pressure sensor 320 and with the speed and load of the engine and the like so that fuel-injection pressure assumes an optimal value, thereby controlling the amount of fuel discharged to the common rail 309. Additionally, the electronic control unit 321 outputs control signals to the injectors 317 to control the fuel-injection timing and spray time in accordance with the running state of the engine, being the speed, load, and the like of the engine.

However, with such a high-pressure fuel-feed pump according to the related art, a clearance of from several microns to several tens of microns between the cylinder inner peripheral wall and the plunger outer peripheral wall is required for plunger sliding. When fuel in the fuel pressurization chamber is pressurized during fuel injection, fuel leaks from the foregoing clearance, and the fuel which has lower viscosity than lubrication oil dilutes the lubrication oil of the engine and thereby the lubrication, cooling, and so on of the various areas of the engine become inadequate, and so engine reliability is caused to be reduced. Similarly, lubrication oil introduced for sliding-portion lubrication within the pump adheres to the plunger and forms an oil film, a fuel oil film on the cylinder inner peripheral wall and a lubrication-oil oil film on the plunger outer peripheral wall make mutual contact due to the sliding of the plunger, and oil leakage in which lubrication oil contaminates the fuel is thereby generated. Due to this oil leakage, lubrication oil within the engine is gradually consumed and thereby the lubrication, cooling, and so on of the various areas of the engine become inadequate, and so engine reliability is caused to be reduced, or the need to frequently perform replenishment of the lubrication oil may occur. Furthermore, the possibility also exists that lubrication oil in the fuel may become a cause of deposits on the nozzle and injector.

To solve this problem, reducing the amount of fuel leakage by installing a seal member on the cylinder inner wall to seal the outer peripheral wall of the plunger may be considered. However, in order to install a seal member on the cylinder inner peripheral wall, it is necessary to provide a space to house the seal member in the cylinder inner wall, and the problems exist whereby the machining steps of the cylinder increase and, along with this, the physical dimensions of the cylinder become larger. When installation space for the seal member is ensured without making the axial physical dimensions of the cylinder larger, the high-pressure seal length of the cylinder and plunger is shortened and seal efficiency drops. Additionally, the number of parts other than the seal member also increases, and so there exists the drawback of higher cost. Furthermore, if a sliding scratch with a depth of from several tenths to several microns is produced on the outer peripheral wall of the plunger because of low-viscosity gasoline, which has scant self-lubricating properties, the exists the problem wherein this sliding scratch contacts the seal member, the seal member is damaged, and seal performance may drop or leakage may occur along the sliding scratch and the amount of fuel may rise.

Increasing the hardness of the plunger by heat treatment, plating, or the like may be considered to prevent the occurrence of sliding scratching on the outer peripheral wall of the plunger, but when plunger hardness is increased, the cylinder becomes susceptible to wear. If the hardness of the cylinder is increased to prevent cylinder wear, ultimately it becomes impossible to prevent the occurrence of sliding scratching on the plunger. It is possible to reduce the occurrence of sliding scratching by introducing lubrication oil into the sliding portion of the plunger and cylinder, but there exists the problem of a sudden increase in oil leakage. Additionally, it is possible to maintain the seal performance of the seal member even if sliding scratching occurs on the plunger by enlarging the urging force of the seal member which contacts the plunger, but this is impractical because the speed of wear of the seal member is hastened.

SUMMARY OF THE INVENTION

It is an object of the present invention to provide a high-pressure fuel-feed pump of high reliability which maintains favorable seal performance between a cylinder and plunger without increasing a body size (physical dimension) of the cylinder.

It is a further object of the present invention to provide a high-pressure fuel-feed pump of high reliability which maintains favorable seal performance between a cylinder and plunger by preventing damage to a seal member to reduce fuel leakage.

To achieve the objects, one preferred mode of the present invention adopts a high-pressure fuel-feed pump including a cylinder having a sliding hole formed to communicate with an intake passage and discharge passage for fuel; a protruding portion protruding from the cylinder along the axial center of the sliding hole to hold the sliding hole therein; a plunger supported reciprocatably and slidably by an inner wall forming the sliding hole; a discharge-timing control valve to determine discharge timing of pressurized fuel by reciprocating motion of the plunger; and a seal member capping the protruding portion from the axial center of the sliding hole and having a hole to receive the plunger and an annular member to liquid-tightly seal an outer peripheral wall of the plunger.

In a high-pressure fuel-feed pump according to the present invention, body size or physical dimensions of the cylinder can be made compact by providing a seal member to liquid-tightly seal the outer peripheral wall of the plunger on the cylinder. Because of this, urging force of an urging device urging for example the plunger can be made smaller on account of lighter weight due to compactness of the member which performs reciprocating motion together with the plunger, and so it becomes possible to install a compression coil spring of greater compactness and make the physical dimensions of the high-pressure fuel-feed pump smaller.

Additionally, according to a high-pressure fuel-feed pump of another preferred mode of the present invention, a portion of the sliding hole is formed by a protruding-portion inner wall of the cylinder protruding in the axial direction of the plunger, and so the seal member can be installed on the protruding-portion outer peripheral wall, without installing the seal member on the protruding-portion inner wall. For this reason, it is possible to reduce deformation of the protruding portion which is the installation location of the seal member due to thermal stress during cylinder heat treatment, and along with this, quench cracking of the cylinder can be prevent. Additionally, the number of the machining step for grinding and the like is reduced after heat treatment.

Furthermore, in a high-pressure fuel-feed pump according to further preferred mode of the present invention, because the noncontacting length of the cylinder and plunger which starts from the lip portion is longer than the lift stroke of the plunger, sliding scratching which may occur at the plunger outer peripheral wall does not extent to the member of annular configuration, and so damage to the sealing member can be prevented, and along with this, leakage of fuel from between the sealing member and the plunger can be reduced.

Still further, in a high-pressure fuel-feed pump according to the still another preferred mode of the present invention, because a fuel pool to collect leaking fuel is partitioned and formed from the seal member, plunger, and cylinder, a fuel pool can be formed not within the cylinder but outside the cylinder, and so the plunger axial length of the cylinder can be shortened, and along with this, machining steps can be reduced.

Moreover, in a high-pressure fuel-feed pump according to the one preferred mode of the present invention, seal performance with the plunger becomes more favorable by fabricating the sealing member with resilient material.

Additionally, in a high-pressure fuel-feed pump according to the sanother preferred mode of the present invention, a fuel pool to collect leaking fuel formed in the interior or exterior of the cylinder and a path having a pressure equal to atmospheric pressure are caused to be communicated, and thereby fuel which has leaked into the fuel pool can be discharged through the path having a pressure equal to atmospheric pressure, and so high pressure is not applied to the seal member. For this reason, leakage of fuel from the sliding portion of the seal member and the plunger can be further suppress, even if the structure of the seal member is simplified.

DETAILED DESCRIPTION OF THE PREFERRED EMBODIMENTS

Preferred embodiments according to the present invention will be described hereinafter with reference to the drawings.

(First Embodiment)

A first embodiment of a high-pressure fuel-feed pump for gasoline-engine use according to the present invention will be described hereinafter with reference to FIG. 1 to FIG. 4.

Figure 1:
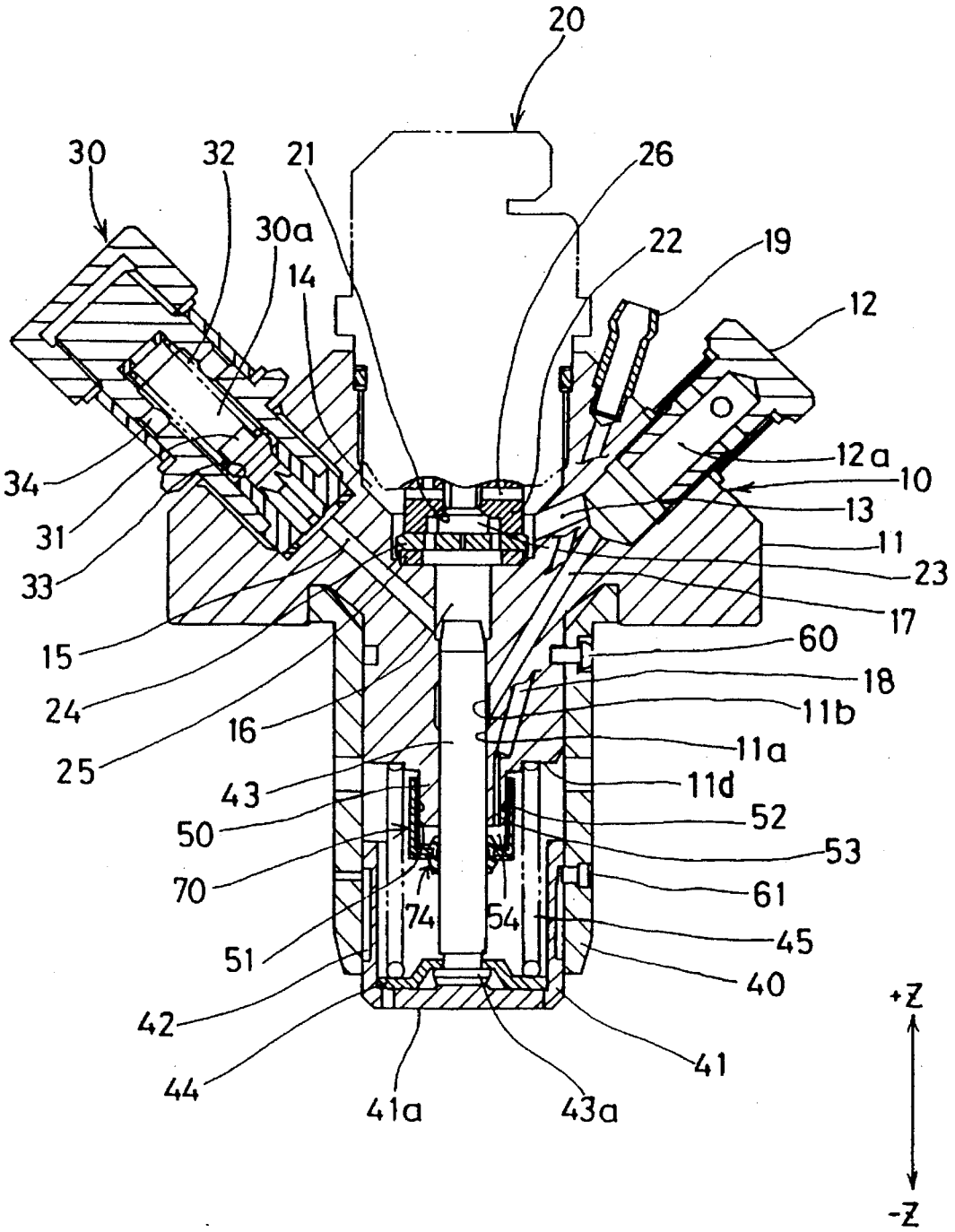
FIG. 1 is a sectional view indicating a pump body according to a first embodiment of the present invention.
Figure 4:
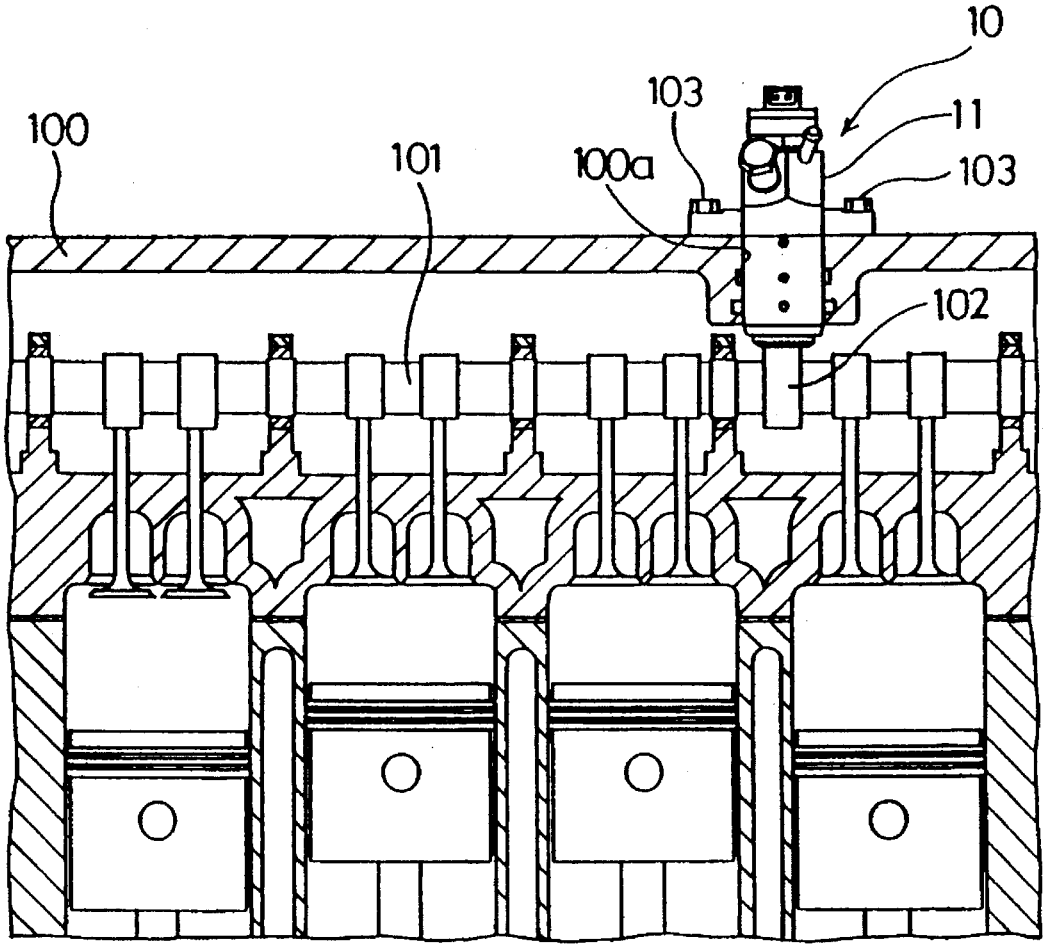
FIG. 4 is a sectional view indicating a state of installation of the pump body according to the first embodiment on an engine head.

A pump body 10 of a high-pressure fuel-feed pump is fixed by a bolt 103 to a head cover 100 which is a portion of an engine cowling, as shown in FIG. 4. A bottom surface of the pump body 10 contacts a pump cam 102 installed to a camshaft 101 to drive an intake/exhaust valve (not illustrated) open and closed, and the pump body 10 is reciprocatingly driven by the pump cam 102 which rotates integrally with the camshaft 101. As shown in FIG. 1, the pump body 10 houses an intake port 12 formed with an intake passage 12*a*, a solenoid valve 20, and a delivery valve 30 in an upper portion of a cylinder 11. Other portions of the pump body 10 are enclosed in a tappet guide 40 of cylindrical configuration. The tappet guide 40 is fixed to the cylinder 11 by a screw 60 or pin.

A fuel pool 11*b* of annular configuration is formed on an inner wall forming a sliding hole or bore 11*a* of the cylinder 11 reciprocatably and slidably supporting a plunger 43 which will be described later. The fuel pool 11*b* is communicated with an intake passage 12*a* via a return passage 17.

The intake passage 12*a* is formed on the intake port 12, and fuel is supplied from a fuel pump not illustrated. The intake passage 12*a* is communicated with a fuel passage 13, and along with this, is communicated with the fuel pool 11*b* via the return passage 17.

The solenoid valve 20 is inserted downwardly with the cylinder, and a valve seat 21 and a valve body 22 formed with a fuel feed passage are accommodated in the interior of the solenoid valve 20. A spill valve 23 is disposed within the valve body 22 contactably and separably with respect to the valve seat 21. An end face of the valve body 22 in –(minus)Z axis direction contacts with a plate 24, an end face of the plate 24 in –Z axis direction contacts with a washer 25, and an end face of the washer 25 in –Z axis direction contacts with the cylinder 11. A fuel gallery 14 of annular configuration is formed on an inner wall of the cylinder 11 surrounding the solenoid valve 20, and this fuel gallery 14 is communicated with the fuel passage 13 and a communicating passage 26.

The delivery valve 30 is connected to a common rail (not illustrated) by fuel steel tubing (not illustrated). The delivery valve 30 is fixed by a screwable link to the cylinder 11, and a fuel passage 30*a* is communicated with a discharge passage 15. A discharge valve 31 is urged toward a valve seat 33 by a compression coil spring 32. When pressure within a fuel pressurization chamber 16 reaches a predetermined pressure or more, the discharge valve 31 is lifted in resistance to the urging force of the compression coil spring 32, and the discharge passage 15 and a discharge port 34 are communicated via the fuel passage 30*a*.

A tappet 41 is formed in a bottomed-cylinder configuration, and a bottom surface 41*a* contacts the pump cam 102 of FIG. 4. The tappet 41 is supported slidably on an inner wall of the tappet guide 40. An oil pool 42 of cylindrical configuration is formed between the inner wall of the tappet guide 40 and the outer wall of the tappet 41, and lubrication oil to prevent seizure of the tappet guide 40 due to reciprocating motion of the tappet 41 is supplied. The tappet 41 is not retained by a pin 61 even at a bottom dead center position of the plunger 43 indicated in FIG. 1, but falling is prevented by the pin 61 during assembly to the head cover 100.

The plunger 43 is supported axially slidably by the cylinder 11 forming the sliding hole 11*a*, and an inner wall of a protruding portion 50 which will be described later, and a seal member 70. A spring sheet 44 is urged in the –Z axis direction of FIG. 1 by a compression coil spring 45, and contacts with an inner bottom surface of the tappet 41. A head portion 43*a* of the plunger 43 is squeezed between the inner bottom surface of the tappet 41 and the spring sheet 44, and is urged in the –Z axis direction of FIG. 1 by the spring sheet 44. The fuel pressurization chamber 16 is formed by the end face of the plunger 43 in the +Z axis direction of FIG. 1, the inner wall of the cylinder 11, and an end face of the solenoid valve 20.

Figure 2:
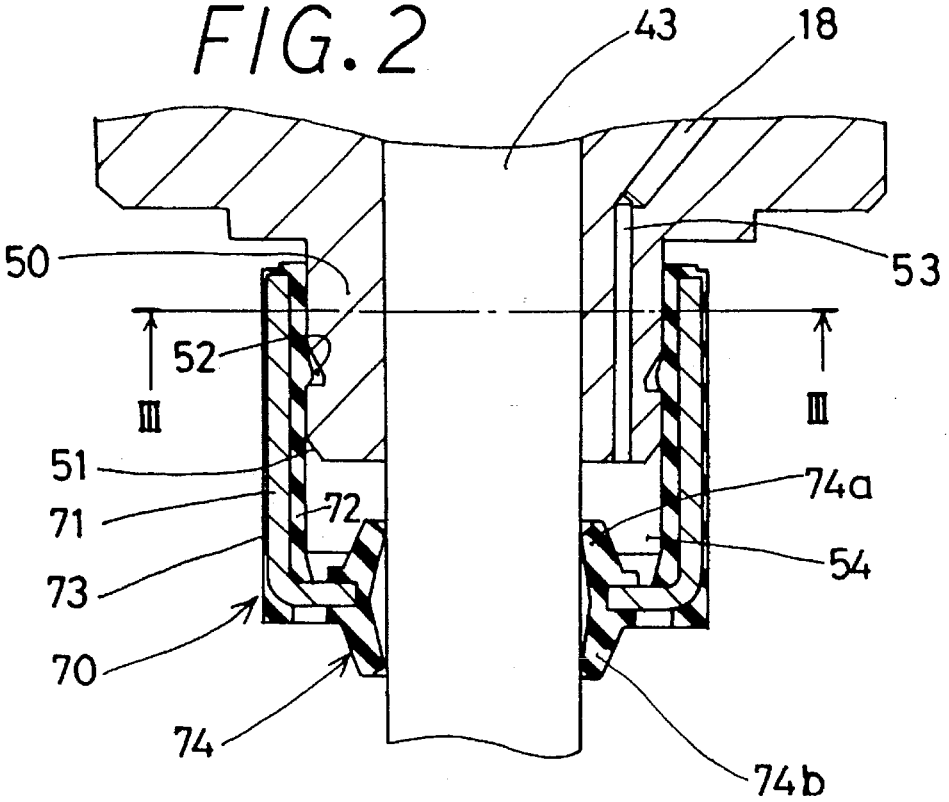
FIG. 2 is an enlarged sectional view indicating major portions of the first embodiment.
Figure 3:
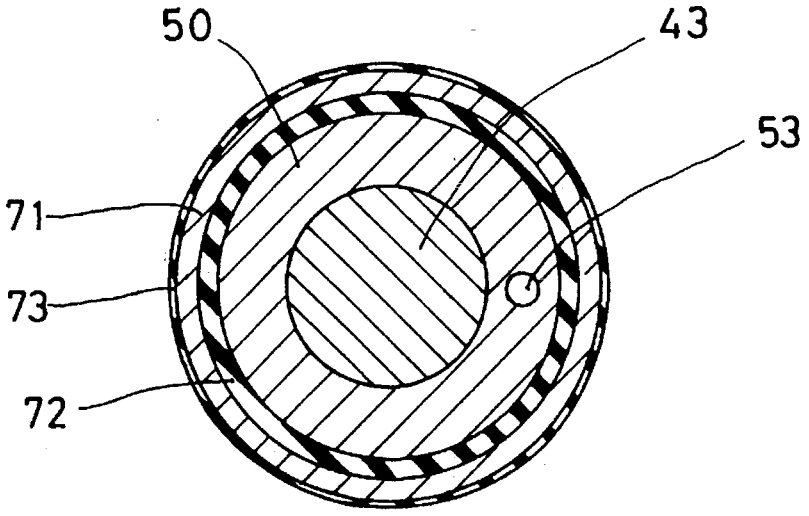
FIG. 3 is a sectional view taken along line III—III of FIG. 2.

The protruding portion 50 is formed integrally on a bottom portion of the cylinder 11 so as to protrude from the cylinder 11, and as shown in FIG. 2, a return passage 53 communicated with a return passage 18 is formed axially in the protruding portion 50. The seal member 70 is mated with an outer wall of the protruding portion 50 by press-fitting. A taper surface 51 which makes the seal member 70 smoothly press-fittable during press-fitting of the seal member 70 and which also prevents damage during press-fitting of the seal member 70 is formed on an end and an outer periphery of the protruding portion 50. The seal member 70 includes a support member 71, an inner-wall cover portion 72, an outer-wall cover portion 73, and a lip portion 74.

The support member 71 is formed in a bottomed-cylinder configuration having a circular through-hole in a bottom portion. The inner-wall cover portion 72, outer-wall cover portion 73, and lip portion 74 are formed integrally. When press-fitting the seal member 70 to the protruding portion 50, the inner-wall cover portion 72 is thrust into a groove 52 of annular configuration formed in the outer wall of the protruding portion 50, preventing dislodgement of the seal member 70.

The lip portion 74 is integrally formed in an annular configuration with an upper lip 74*a* and a lower lip 74*b*, and contacts with the outer peripheral wall of the plunger 43 by elastic force. An inner diameter of the lip portion 74 is formed so that inner diameter is gradually reduced moving from an axial center portion toward the upper lip 74*a* and lower lip 74*b*. Inner surfaces of the upper lip 74*a* and lower lip 74*b* to contact with the outer peripheral wall of the plunger 43 respectively form predetermined angles with the outer peripheral wall of the plunger 43 at an annular sliding portion; the upper lip 74*a* primarily reduces the amount of fuel leakage from a fuel pool 54 to the tappet 41 side, and the lower lip 74*b* primarily reduces the amount of leakage of oil for lubrication use leaking from the sliding portion of the tappet guide 40 and tappet 41, along an oil chamber formed by a cylinder end face 11*d*, the tappet 41 which is a drive-transmission member, and tappet guide 40, and to the fuel pool 54. Because the upper lip 74*a* and lower lip 74*b* have a mode of operation which thins a fuel oil film covering the outer peripheral wall of the plunger 43, the amount of leakage of fuel or oil can be reduced.

The fuel pool 54 is formed by an end face of the protruding portion 50, the outer peripheral wall of the plunger 43, and the inner-wall cover portion 72. The fuel pool 54 is communicated with the return passage 18 via the return passage 53.

Operation of the high-pressure fuel-feed pump will be described hereinafter with reference to FIG. 1, FIG. 2, and FIG. 4, with the description divided into 1) a fuel intake stroke and 2) a fuel pressurization and pumping stroke.

1) Fuel intake stroke

The pump cam 102 rotates along with the rotation of the valve camshaft 101, and the plunger 43 reciprocates together with the tappet 41 and spring sheet 44. When the plunger 43 is positioned at the maximum position in the +Z axis direction, which is top dead center, conductance to a solenoid not illustrated of the solenoid valve 20 is interrupted. When this occurs, the spill valve 23 separates from the valve seat 21 due to urging force of a compression coil spring not illustrated, and the solenoid valve 20 assumes a valve-open state. At this time, the plunger 43 moves in the –Z axis direction, and thereby low-pressure fuel discharged from the fuel pump flows via the intake passage 12*a*, fuel passage 13, fuel gallery 14, and communicating passage 26 into the fuel pressurization chamber 16. Accordingly, when the plunger 43 is positioned at the maximum position in the –Z axis direction, which is bottom dead center, a maximum amount of fuel flows into the fuel pressurization chamber 16.

2) Fuel pressurization and pumping stroke

In a stroke wherein the plunger 43 moves in the +Z axis direction, when the plunger 43 reaches a position corresponding to a desired fuel discharge amount before the plunger reaches top dead center, the solenoid of the solenoid valve 20 is energized by an electronic control (not illustrated). Due to this, the spill valve 23 moves in the +Z axis direction and contacts the valve seat 21. That is to say, the solenoid valve 20 assumes a valve-closed state. Thereafter, when the plunger 43 moves further in the +Z axis direction, the fuel within the fuel pressurization chamber 16 becomes high in pressure and the discharge valve 31 separates from the valve seat 33, and thereby the high-pressure fuel is discharged via the discharge passage 15, fuel passage 30*a*, and discharge port 34 from the delivery valve 30 to a common rail (not illustrated). In the interval after the solenoid valve 20 opens until the plunger 43 reached top dead center, fuel is supplied to the common rail, and when the pressure differential of the fuel upstream side and the fuel downstream side of the discharge valve 31 becomes small, the discharge valve 31 contacts the valve seat 33 due to the urging force of the compression coil spring 32, and the delivery valve 30 is closed. Backwash of fuel from the fuel downstream side is prevented by this. During fuel pressurization and pumping, a portion of the high-pressure fuel within the fuel pressurization chamber 16 may flow into the sliding portion of the plunger 43 and cylinder 11. This inflowing fuel collects in the fuel pool 11*b* indicated in FIG. 1, and is returned through the return passage 17 to the intake passage 12*a*. Because fuel pressure, albeit low pressure, is applied in the intake passage 12*a*, fuel which has collected in the fuel pool 11b may flow in the –Z axis direction. Because this fuel collects in the fuel pool 54, and is returned from a return connector 19 via the return passage 53 and the return passage 18 and finally to the fuel tank, there is no intermixing of fuel with engine oil. Because the pressure within the return passage 18 is equal to atmospheric pressure, the fuel pressure within the fuel pool 54 is lowered and no high pressure is applied to the seal member 70 which forms the fuel pool 54. For this reason, leakage of leaking fuel collected within the fuel pool 54 from the sliding portion of the lip portion 74 and plunger 43 can be suppressed even if the structure of the seal member 70 itself is simplified. Additionally, the junction structure of the protruding portion 50 and the seal member 70 can be simplified.

According to the first embodiment, the required length of the cylinder 11 such that the plunger 43 does not tilt and the required length of the protruding portion 50 such that the seal member 70 does not tilt can be disposed axially in parallel and axial length can be made smaller by press-fitting the seal member 70 to the outer wall of the protruding portion 50 formed integrally with the end portion of the cylinder 11. Additionally, the seal member 70 is formed in a cup configuration, and the interval with the plunger is sealed by the bottom portion of the cup and fixed to the protruding portion 50 by the side-wall portion of the cup. Consequently, a side-wall portion plate thickness which is only a plate thickness required for fixing is sufficient, and the outer diameter of the side-wall portion can be made smaller, and moreover the protruding portion 50 can be formed compactly and of thick plate thickness, and so there exists an effect in which deformation during heat treatment of the cylinder 11 can be reduced, and along with this, machining of the sliding hole 11*a* is facilitated. Furthermore, the members of the tappet 41 and the like which reciprocate together with the plunger 43 can be made compact, and together with this, the urging force of the compression coil spring 45 can be made smaller, and so the physical dimensions of the pump body 10 can be made smaller.

According to the first embodiment, moreover, because the fuel pool 54 partitioned and formed by the end face of the protruding portion 50, the outer peripheral wall of the plunger 43, and the inner-wall cover portion 72 was made to be a fuel pool of low pressure, there is no need to form a fuel pool in the inner wall of the cylinder 11 which forms the sliding hole 11*a*, and the shaft length of the cylinder can be shortened and machining process steps can be reduced.

According to the first embodiment, furthermore, a fuel pool 54 for low-pressure leaking fuel is provided in addition to the fuel pool 11*b* for high-pressure leaking fuel, and the amount of fuel returned to the fuel tank from the return passage 18 via the return connector 19 is thereby reduced. For this reason, it becomes possible to reduce the discharge amount of HC arising from heating of returning fuel by radiant heat and the like of the engine.

Still further, according to the first embodiment the pump body 10 is housed in the head cover 100, and in addition to this a common rail is normally disposed in the proximity of the combustion chamber, and so the length of the fuel steel tubing connecting the pump body 10, common rail, and combustion chamber can be shortened.

A fuel pool 54 for low-pressure leaking fuel and a fuel pool 11*b* for high-pressure leaking fuel were provided according to the first embodiment, but according to the present invention it is also acceptable to provide only a fuel pool for low-pressure leaking fuel, and the amount of fuel which leaks is reduced and the fuel pressurization and pumping efficiency of the high-pressure fuel-feed pump can be improved in this case as well. Because of this, improved fuel consumption of the engine becomes possible.

According to the first embodiment, the pump body 10 was installed on the head cover 100, which is a portion of the engine housing, but according to the present invention it is possible to install a pump body on a cylinder head which is a portion of the engine housing.

(Second Embodiment)

Figure 5:
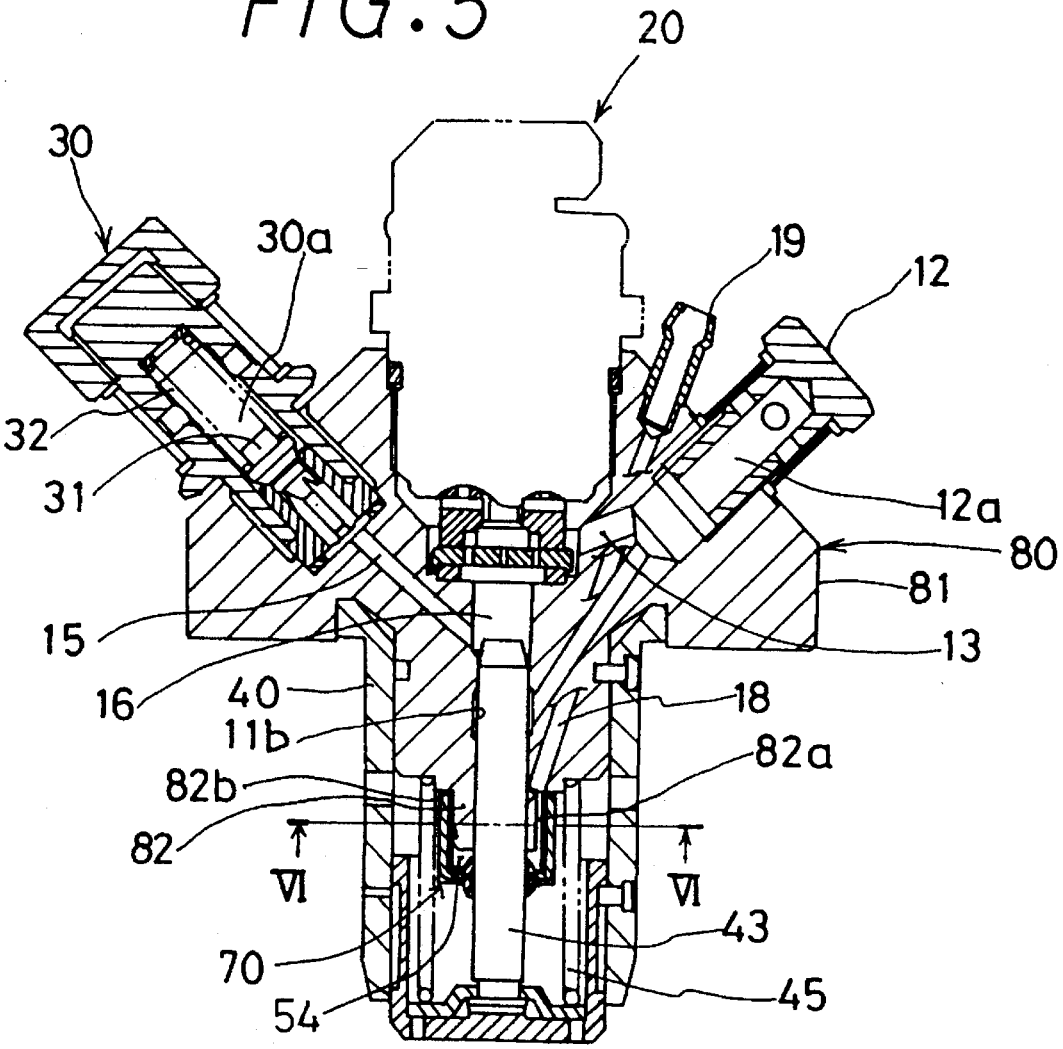
FIG. 5 is a sectional view indicating a pump body according to a second embodiment of the present invention.
Figure 6:
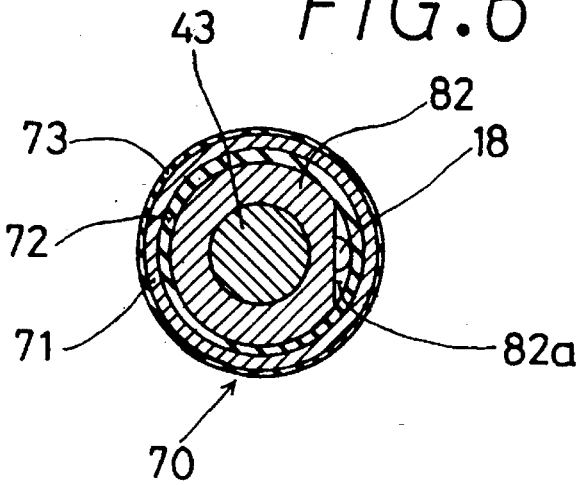
FIG. 6 is a sectional view taken along line VI—VI of FIG. 5.

A second embodiment according to the present invention is indicated in FIG. 5 and FIG. 6. A pump body 80 of a high-pressure fuel-feed pump cuts a transversely arcuate configuration axially in an outer wall of a protruding portion 82 formed integrally with a cylinder 81 to form a return passage 82*a*. A fuel pool 54 is communicated with a return passage 18 via the return passage 82*a*. A seal member 70 is press-fitted into the outer wall of the protruding portion 82, and is compressed into a step 82*b* formed on the protruding portion 82. For this reason, leakage of fuel from the return passage 82*a* or 18 is prevented.

According to the second embodiment, machining of the return passage 82*a* communicating the fuel pool 54 and the return passage 18 is made easier and machining costs are made lower in comparison with the first embodiment by forming the return passage 82*a* by axially cutting the protruding portion 82.

(Third Embodiment)

Figure 7:
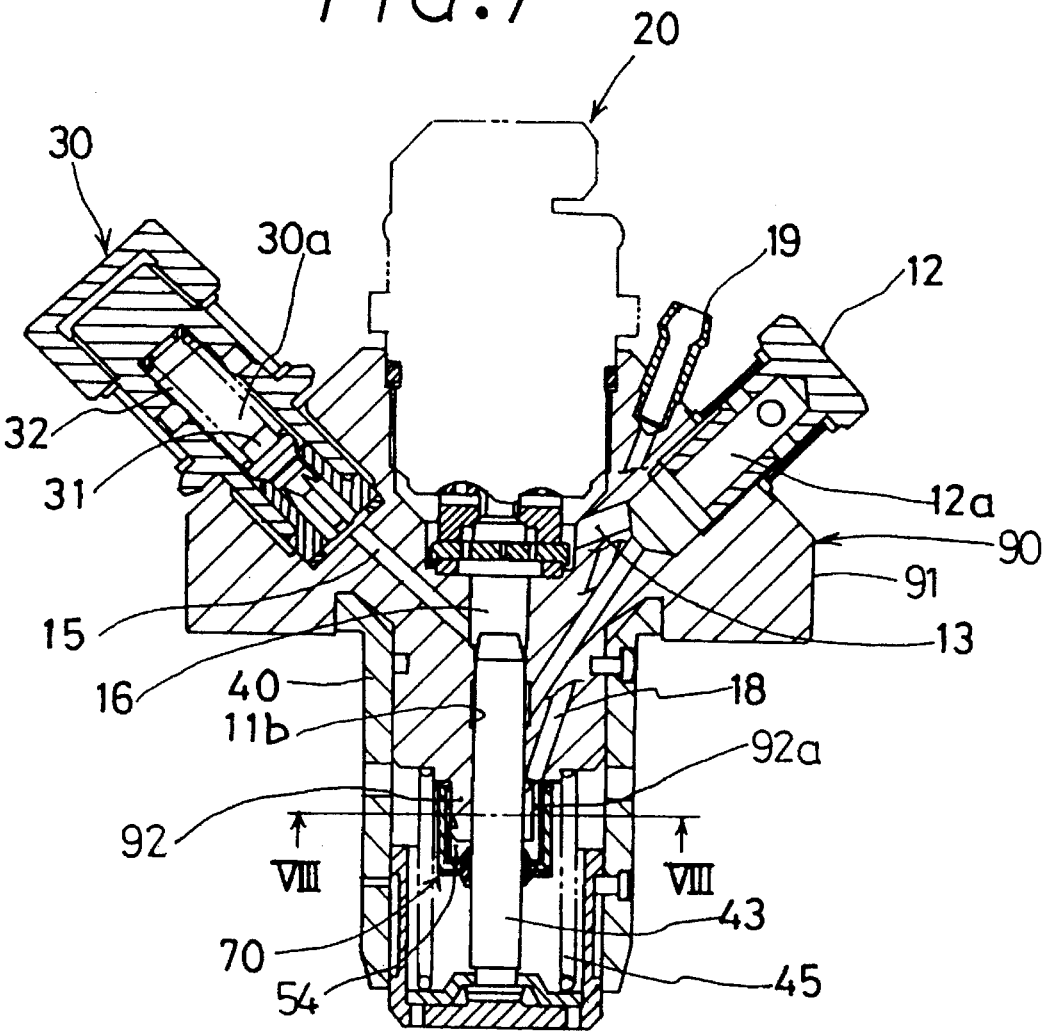
FIG. 7 is a sectional view indicating a pump body according to a third embodiment of the present invention.
Figure 8:
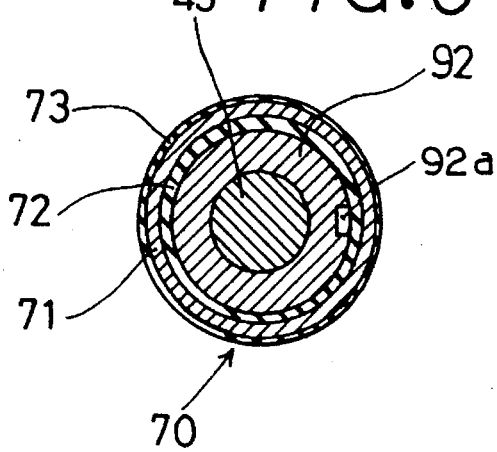
FIG. 8 is a sectional view taken along line VIII—VIII of FIG. 7.

A third embodiment according to the present invention is indicated in FIG. 7 and FIG. 8. A pump body 90 of a high-pressure fuel-feed pump has a return passage 92*a* formed into an axially grooved configuration in an outer wall of a protruding portion 92 formed integrally with a cylinder 91. A fuel pool 54 is communicated with a return passage 18 via the return passage 92*a*.

According the third embodiment, similarly to the second embodiment, machining of the return passage 82*a* communicating with the fuel pool 54 is made easier and machining costs are made lower in comparison with the first embodiment.

(Fourth Embodiment)

Figure 9:
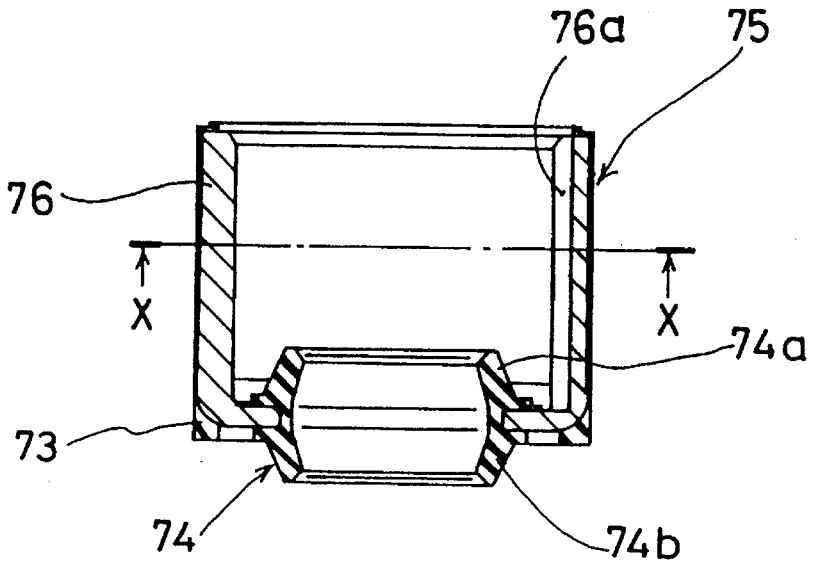
FIG. 9 is a sectional view indicating a pump body according to a fourth embodiment of the present invention.
Figure 10:
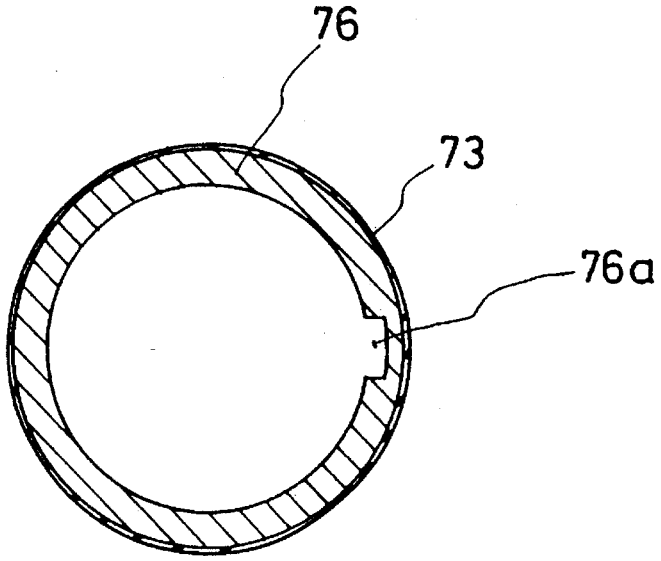
FIG. 10 is a sectional view taken along line X—X of FIG. 9.

A fourth embodiment according to the present invention is indicated in FIG. 9 and FIG. 10. According to the fourth embodiment, an inner-wall cover portion covering an inner peripheral wall of a support member 76 of a seal member 75 is eliminated, and the inner peripheral wall of the support member 76 of metal fabrication is press-fitted so as to directly touch a protruding-portion outer wall of a cylinder not illustrated. A return passage 76*a* of grooved configuration is formed axially in the inner peripheral wall of the support member 76. Fuel is discharges via this return passage 76*a* from a pump body not illustrated.

According to the fourth embodiment, there is no need to form in the protruding portion a groove for dislodgement-prevention use of the seal member 75 because the inner-wall cover member of the seal member 75 is eliminated and the support member 76 of metal fabrication is press-fitted to the protruding portion of the cylinder, and so machining process steps are reduced. Furthermore, press-fitting looseness due to thermal expansion and dislodgement of the seal member 75 due to deformation of the inner-wall cover portion of rubber fabrication can be prevented.

(Fifth Embodiment)

Figure 11:
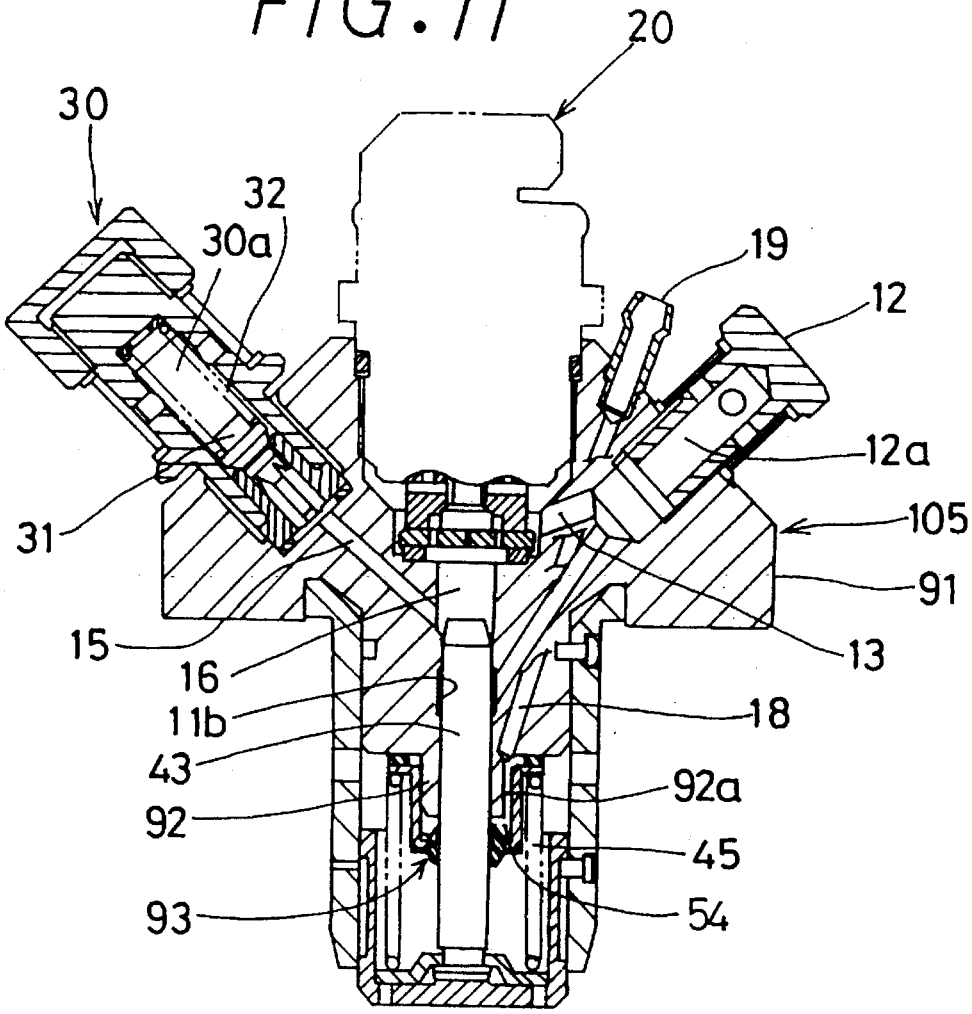
FIG. 11 is a sectional view indicating a pump body according to a fifth embodiment of the present invention.
Figure 12:
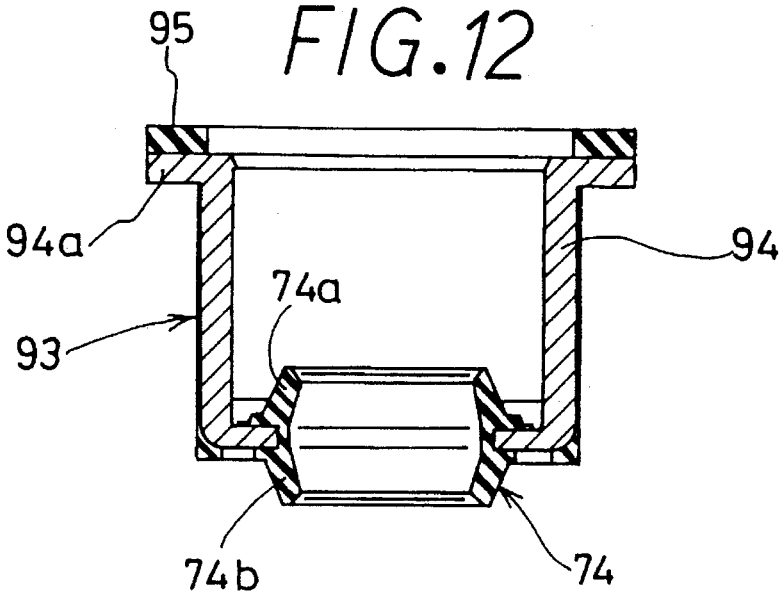
FIG. 12 is a sectional view indicating a seal member according to the fifth embodiment.

A fifth embodiment according to the present invention is indicated in FIG. 11 and FIG. 12. A seal member 93 of a pump body 105 of a high-pressure fuel-feed pump is mated with a protruding portion 92 formed integrally with a cylinder 91. A support member 94 is formed in a bottomed-cylinder configuration having a circular through-hole in a bottom portion, and a flange portion 94*a* is formed in an end portion in the direction of press-fitting of the seal member 93. An inner-wall cover portion covering an inner peripheral wall of the support member 94 is eliminated, and a uniform clearance is formed between the inner peripheral wall of the support member 94 and an outer peripheral wall of the protruding portion 92. A gasket 95 of rubber fabrication and formed in an annular configuration is squeezed between the flange portion 94*a* and the cylinder 91 by urging force of a compression coil spring 45, sealing the interval between the seal member 93 and the cylinder 91. The seal member 93 is urged toward the cylinder 91 by the urging force of the compression coil spring 45, and so dislodgement is prevented.

According to the fifth embodiment, there is no need to press-fit the seal member 93 to the protruding portion 92 because the interval between the seal member 93 and the cylinder 91 is sealed by the gasket 95, and so radial machining accuracy of the seal member is not required and so machining process steps are reduced. Additionally, because dislodgement of the seal member 93 is prevented by the urging force of the compression coil spring 45, there is no need to form a groove for dislodgement-prevention use of the seal member 93 in the outer peripheral wall of the protruding portion 92, and so machining of the cylinder is facilitated.

(Sixth Embodiment)

Figure 13:
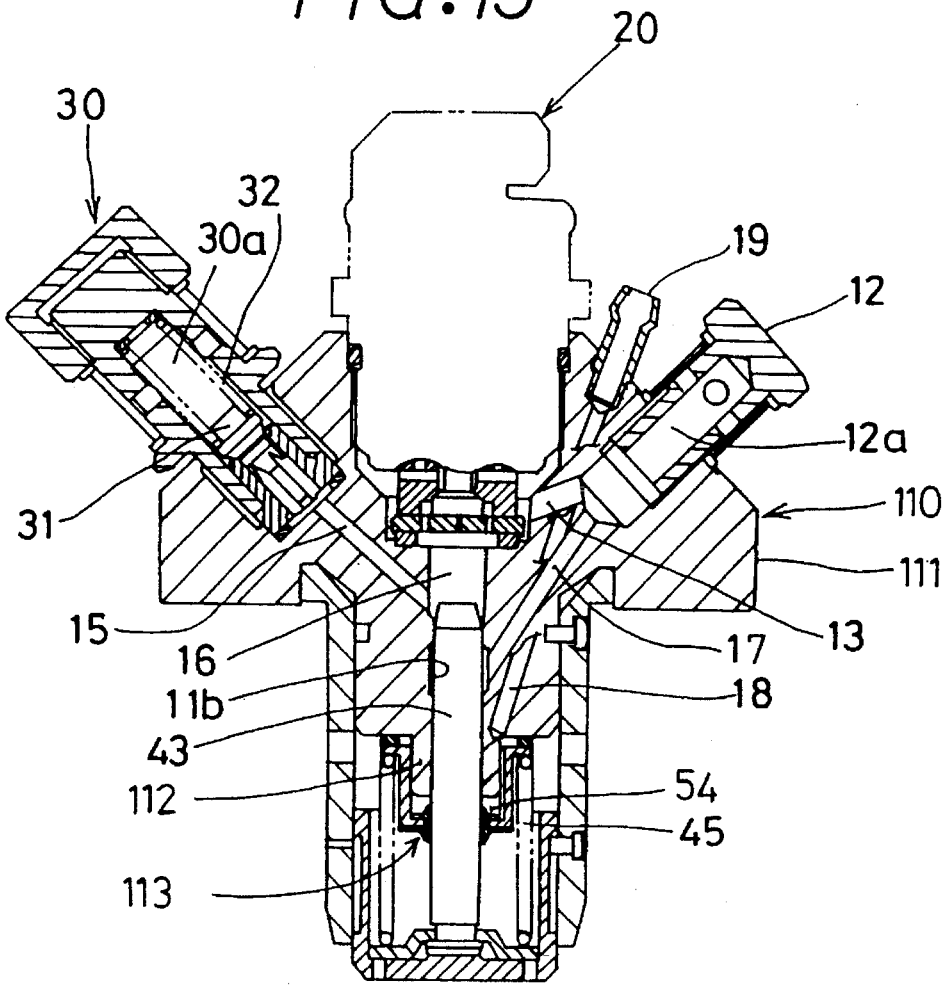
FIG. 13 is a sectional view indicating a pump body according to a sixth embodiment of the present invention.
Figure 14:
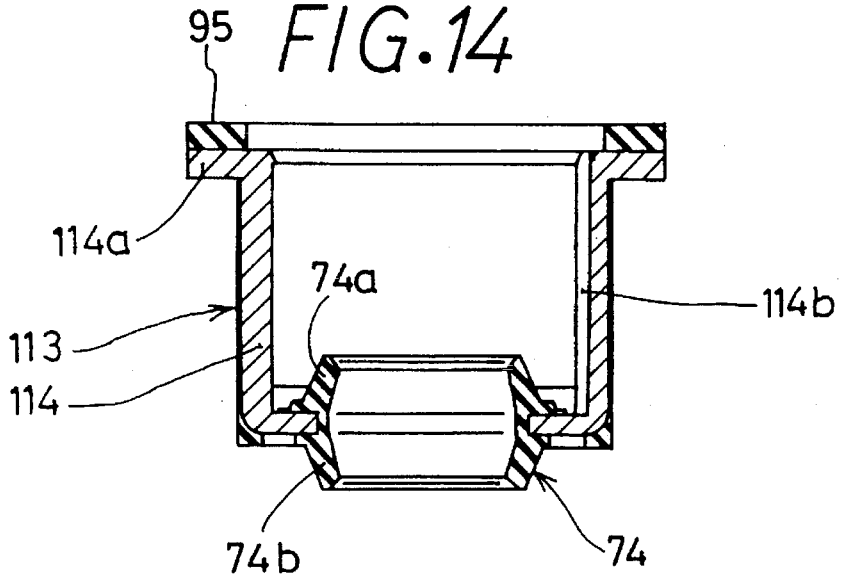
FIG. 14 is a sectional view indicating a seal member according to the sixth embodiment.

A sixth embodiment according to the present invention is indicated in FIG. 13 and FIG. 14. A seal member 113 of a pump body 110 of a high-pressure fuel-feed pump is mated with a protruding portion 112 formed integrally with a cylinder 111. A support member 114 is formed in a bottomed-cylinder configuration having a circular through-hole in a bottom portion, and a flange portion 114*a* is formed in an end portion in the direction of press-fitting of the seal member 113. An inner-wall cover portion covering an inner peripheral wall of the support member 114 is eliminated, and a uniform clearance is formed between the inner peripheral wall of the support member 114 and an outer peripheral wall of the protruding portion 112. A groove 114*b* is formed in an axial direction in the inner wall of the support member 114. This groove 114*b* is communicated with a return passage 18, and discharges fuel within a fuel pool 54 via the return passage 18. A gasket 95 of rubber fabrication and formed in an annular configuration is squeezed between the flange portion 114*a* and the cylinder 111 by urging force of a compression coil spring 45, sealing the interval between the seal member 113 and the cylinder 111. The seal member 113 is urged toward the cylinder 111 by the urging force of the compression coil spring 45, and so dislodgement is prevented.

According to the sixth embodiment, because a groove for fuel-discharge use is provided in the seal member 113 and dislodgement of the seal member 113 is prevented by the urging force of the compression coil spring 45, there is no need to form a groove for dislodgement-prevention use of the seal member 113 in the outer peripheral wall of the protruding portion 112, and so machining of the cylinder 111 is facilitated and machining process steps of the cylinder 111 are reduced. Furthermore, there is no need to press-fit the seal member 113 to the protruding portion 112 because the interval between the seal member 113 and the cylinder 111 is sealed by the gasket 95, and so radial machining accuracy of the seal member is not required and so machining process steps are reduced.

(Seventh Embodiment)

Figure 15:
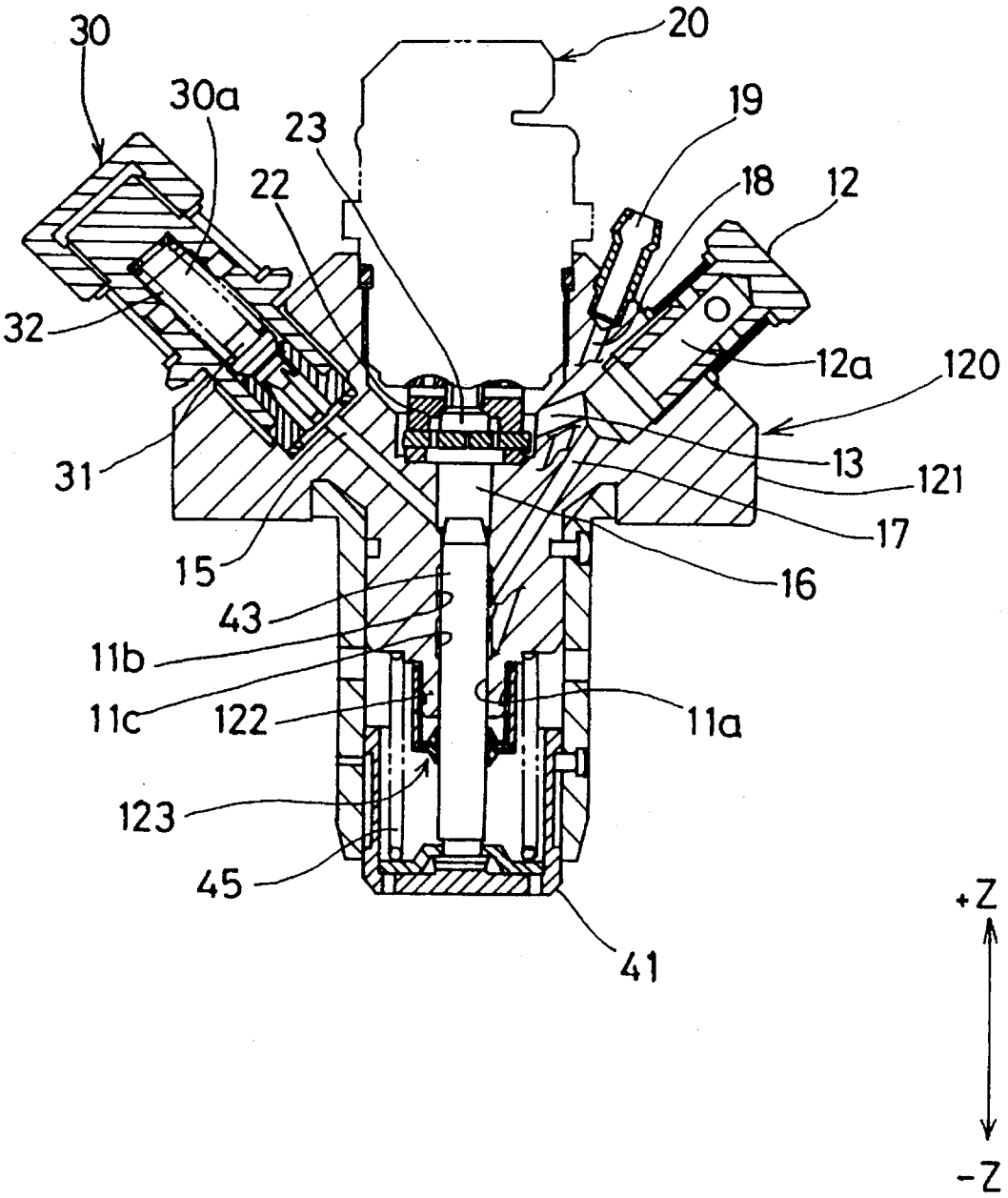
FIG. 15 is a sectional view indicating a pump body according to a seventh embodiment of the present invention.

A seventh embodiment according to the present invention is indicated in FIG. 15. A seal member 123 of a pump body 120 of a high-pressure fuel-feed pump is press-fitted to an outer wall of a protruding portion 122 formed integrally with a cylinder 121. The structure of the seal member 123 is similar to that of the first embodiment. A fuel pool 11*b* for high-pressure use and a fuel pool 11*c* for low-pressure use formed in an annular configuration are formed in an inner wall formed with a sliding hole 11*a* of the cylinder 121, and the fuel pool 11*c* is communicated with a return passage 18. When fuel which has collected in the fuel pool 11*b* flows in a –Z axis direction and collects in the fuel pool 11*c*, it is returned from a return connector 19 via the return passage 18 and finally to the a tank, and so there is no intermixing of fuel with engine oil. Additionally, because the pressure within the return passage 18 is equal to atmospheric pressure, the fuel pressure within the fuel pool 11*c* is lowered. For this reason, even if fuel further leaks from the fuel pool 11*c* to the seal member 123 side, the pressure of this leaking fuel is low, and so no high pressure is applied to the seal member 123. Because of this, leakage of leaking fuel collected within the fuel pool 11*c* from the sliding portion of the seal member 123 and the plunger 43 can be suppressed even if the structure of the seal member 123 itself is simplified. Additionally, the junction structure of the protruding portion 122 and the seal member 123 can be simplified.

(Eight Embodiment)

Figure 16:
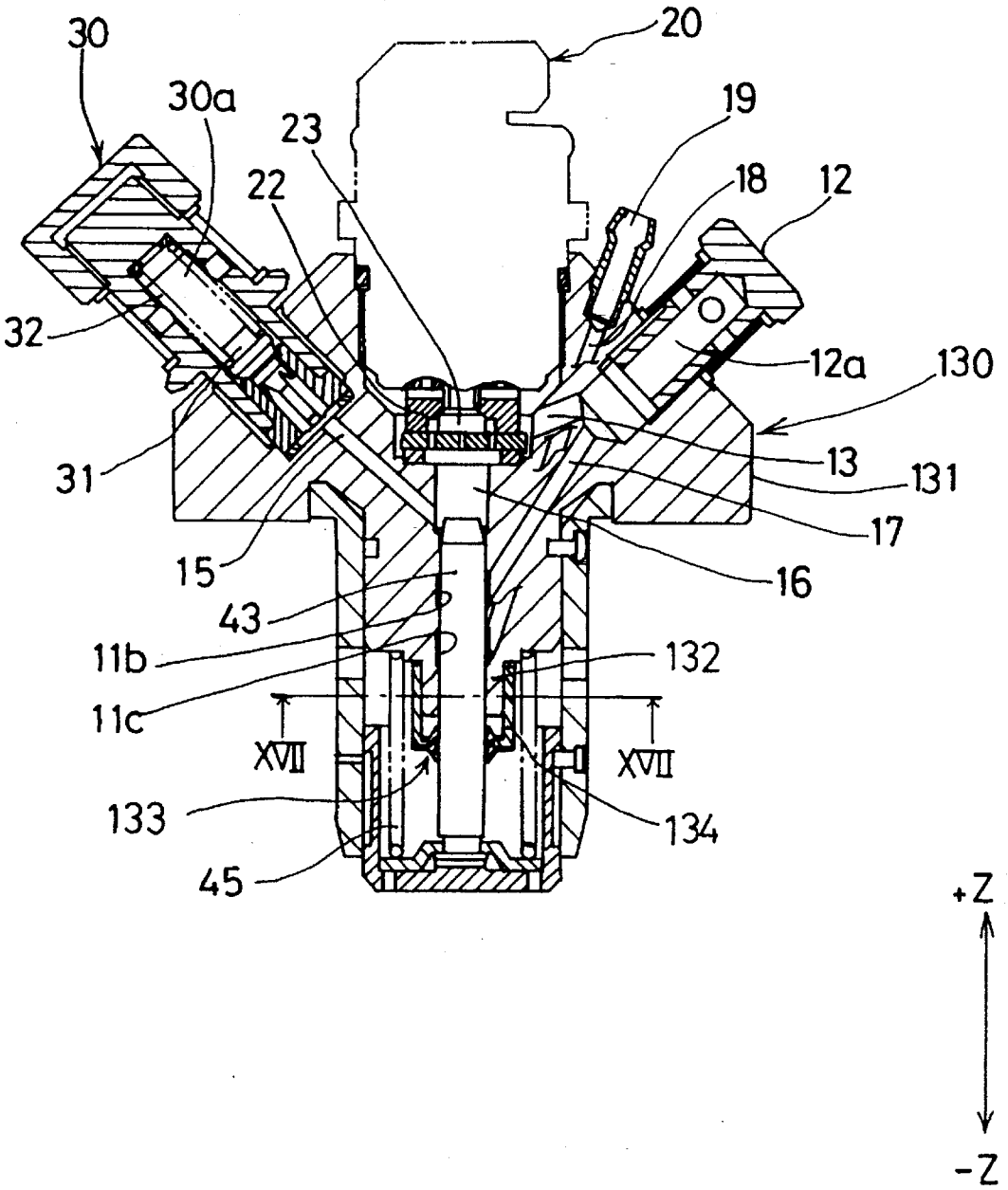
FIG. 16 is a sectional view indicating a pump body according to an eighth embodiment of the present invention.
Figure 17:
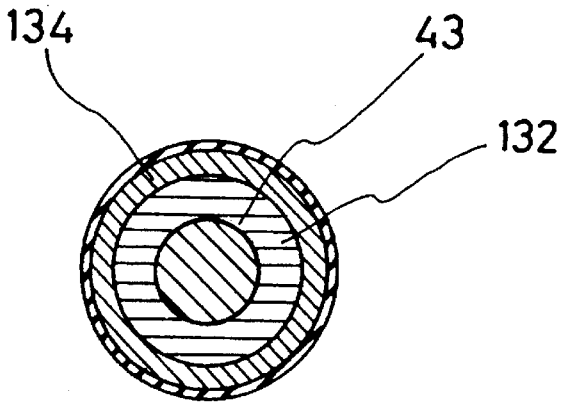
FIG. 17 is a sectional view taken along line XVII—XVII of FIG. 16.
Figure 18:
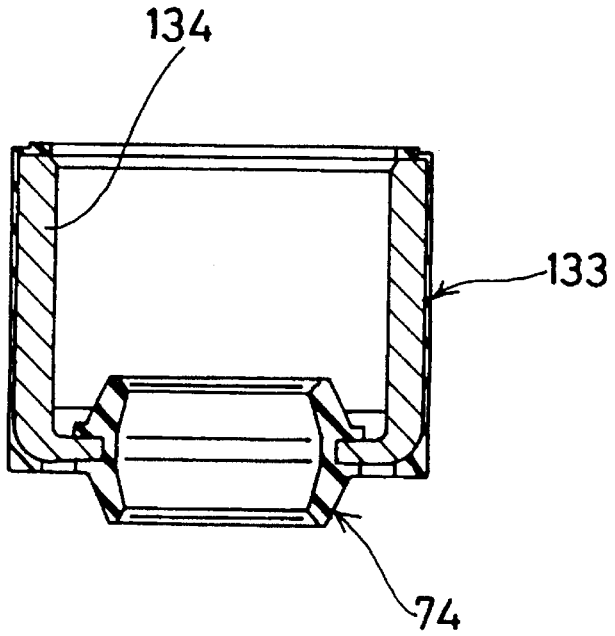
FIG. 18 is a sectional view indicating a seal member according to the eighth embodiment.

An eighth embodiment according to the present invention is indicated in FIG. 16 to FIG. 18. A seal member 133 of a pump body 130 of a high-pressure fuel-feed pump is press-fitted to an outer wall of a protruding portion 132 formed integrally with a cylinder 131. As shown in FIG. 18, an inner-wall cover portion covering an inner peripheral wall of a support member 134 is eliminated, and so the inner peripheral wall of the support member 134 directly touches the outer peripheral wall of the protruding portion 132, as shown in FIG. 17.

For this reason, there is no need to form a groove for dislodgement-prevention use of the seal member 133, and so machining process steps of the cylinder 111 are reduced. Additionally, because the inner peripheral wall of the support member 134 of metal fabrication touches the outer peripheral wall of the protruding portion 132, looseness of the press-fit portion due to heat such as in a case where rubber touches metal can be prevented.

(Ninth Embodiment)

Figure 19:
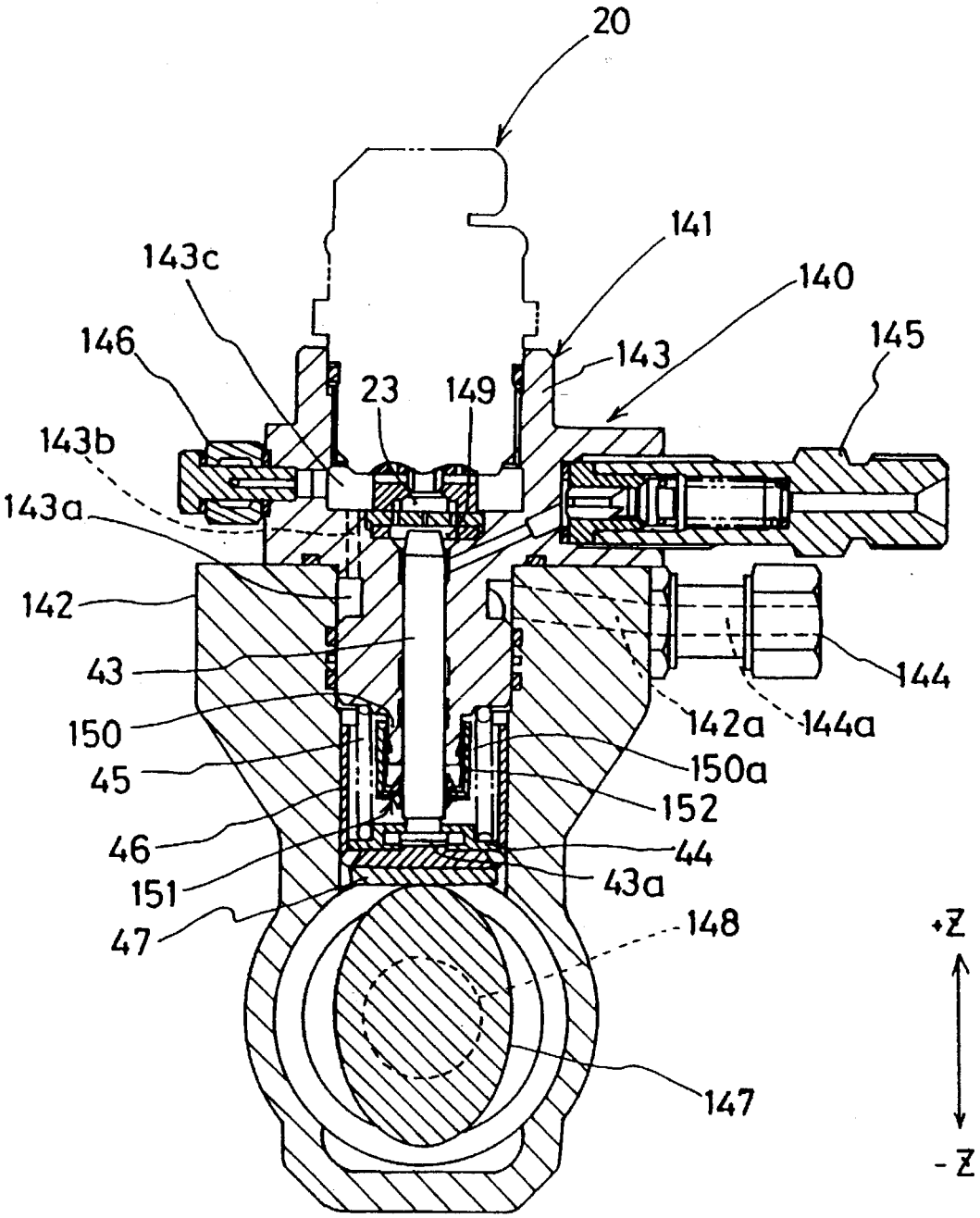
FIG. 19 is a sectional view indicating a high-pressure fuel-feed pump according to a ninth embodiment of the present invention.

A ninth embodiment according to the present invention is indicated in FIG. 19. A pump body 140 of a high-pressure fuel-feed pump is housed in a pump housing 142. A solenoid valve 20, delivery valve 145, and overflow valve 146 are installed on a cylinder 143. A seal member 151 of a structure similar to the seal member according to the first embodiment is press-fitted into a protruding portion 150 of the cylinder 143 on a pump cam 147 side, and an inner-wall cover portion 152 of rubber fabrication is thrust into a groove 150*a* provided in the outer peripheral wall of the cylinder 143. A spring sheet 44 is urged in the –Z axis direction of FIG. 19 by a compression coil spring 45, and contacts an inner bottom surface of a tappet 46. A head portion 43*a* of a plunger 43 is squeezed between the inner bottom surface of the tappet 46 and the compression coil spring 45, and is urged in the –Z axis direction of FIG. 19 by the spring sheet 44. A protective plate 47 is fixed to the bottom surface in the –Z axis direction of FIG. 19 of the tappet 46, and prevents wear due to sliding with the pump cam 147. The pump cam 147 rotates integrally with a camshaft 148 and reciprocatingly drives the plunger 43.

An intake passage 144*a* is formed in a fuel inlet 144, and is communicated with a fuel passage 142*a* formed in the pump housing 142. Fuel introduced from the fuel inlet 144 flows from the intake passage 144*a*. The fuel passage 142*a*, a fuel gallery 143*a* formed in an annular configuration on an outer peripheral surface of the cylinder 143, a fuel passage 143*b*, and a fuel gallery 143*c* via the solenoid valve 20 and into a fuel pressurization chamber 149.

According to the ninth embodiment, the fuel leakage amount can be favorably reduced by the seal member 151 press-fitted to the outer wall of the protruding portion 150 formed on the pump cam 147 side of the 143.

(Tenth Embodiment)

Figure 20:
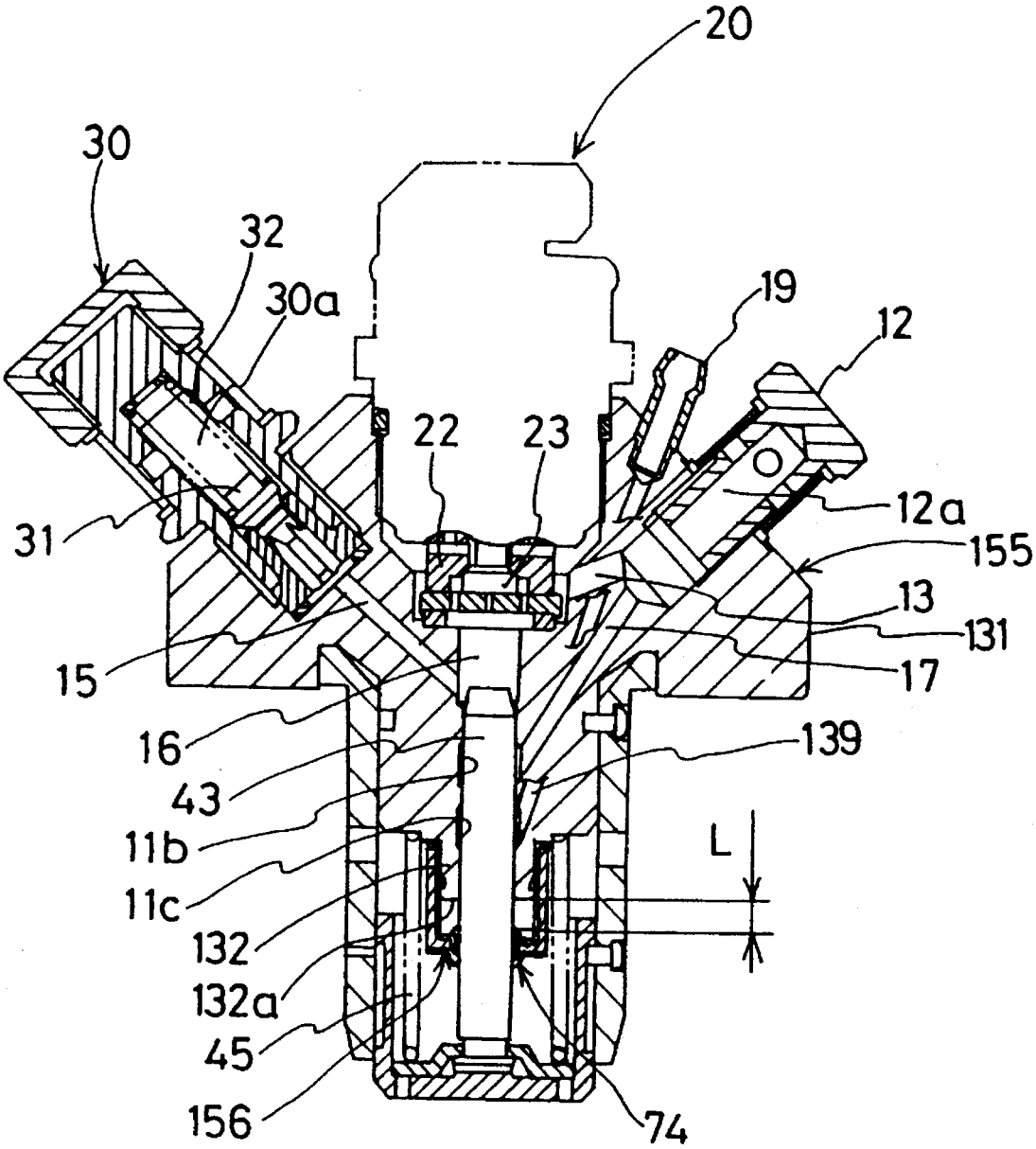
FIG. 20 is a is a sectional view indicating a pump body according to a tenth embodiment of the present invention.

A tenth embodiment according to the present invention is indicated in FIG. 20. A seal member 156 of a pump body 155 of a high-pressure fuel-feed pump is press-fitted to an outer wall of a protruding portion 132 formed integrally with a cylinder 131. An axis length of the seal member 156 is formed so that length L from a lip portion 74 of the seal member 156 to a bottom surface 132*a* of the protruding portion 132 becomes longer than a lift stroke of a plunger 43.

For this reason, even if sliding scratching occurs on an outer peripheral wall of the plunger 43 due to sliding of the plunger 43 and the cylinder 131, this sliding scratching does not extend to the seal position of the lip portion 74. Because the outer peripheral surface of the plunger 43 touching the lip portion 74 is a smooth surface which is always free of sliding scratching, damage to the lip portion 74 due to sliding scratching which occurs on the outer peripheral surface of the plunger 43 can be prevented. Furthermore, leakage of fuel from a space which is produced between the lip portion 74 and sliding scratching can also be prevented.

The seal member 156 according to the tenth embodiment is of a structure installed on the cylinder 131 by press-fitting to the outer peripheral surface of the protruding portion 132. For this reason, according to the present invention, the length from the protruding-portion end face to the seal position can easily be adjusted by increasing or decreasing the axis length of the seal member, and so the lift stroke of the plunger can be increased and the pressurization and pumping capacity of the high-pressure fuel-feed pump can easily be improved by increasing the axis length of for example the seal member.

(Eleventh Embodiment)

Figure 21:
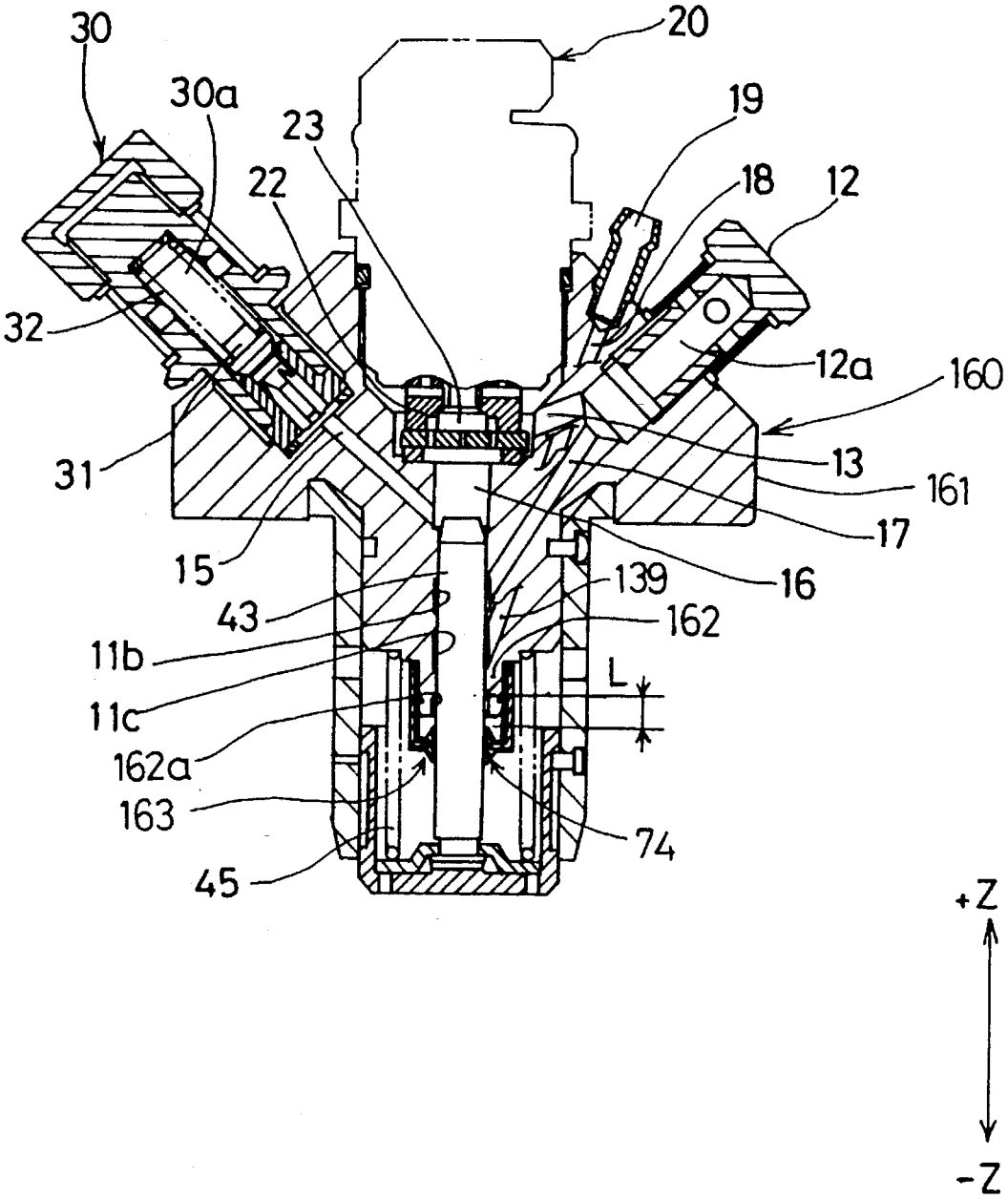
FIG. 21 is a is a sectional view indicating a pump body according to an eleventh embodiment of the present invention.

An eleventh embodiment according to the present is indicated in FIG. 21. A seal member 163 of a pump body 160 of a high-pressure fuel-feed pump is press-fitted to an outer wall of a protruding portion 162 formed integrally with a cylinder 161. A recess portion 162*a* of cylindrical configuration is formed on an inner wall of the cylinder 161 forming a sliding hole, below a fuel pool 11*c*. This recess portion 162*a* forms a uniform clearance with a plunger 43, and is disposed so as not to touch the plunger 43 during reciprocating motion of the plunger 43. An axis length of the seal member 163 is formed so that length L from an upper end of this recess portion 162*a* to an upper end of a lip portion 74 becomes longer than a lift stroke of the plunger 43.

For this reason, even if sliding scratching occurs on an outer peripheral wall of the plunger 43 due to sliding of the plunger 43 and the cylinder 161, this sliding scratching does not extend to the seal position of the lip portion 74. Because the outer peripheral surface of the plunger 43 touching the lip portion 74 is a smooth surface which is always free of sliding scratching, damage to the lip portion 74 due to sliding scratching which occurs on the outer peripheral surface of the plunger 43 can be prevented. Furthermore, leakage of fuel from a space which is produced between the lip portion 74 and sliding scratching can also be prevented.

(Twelfth Embodiment)

Figure 22:
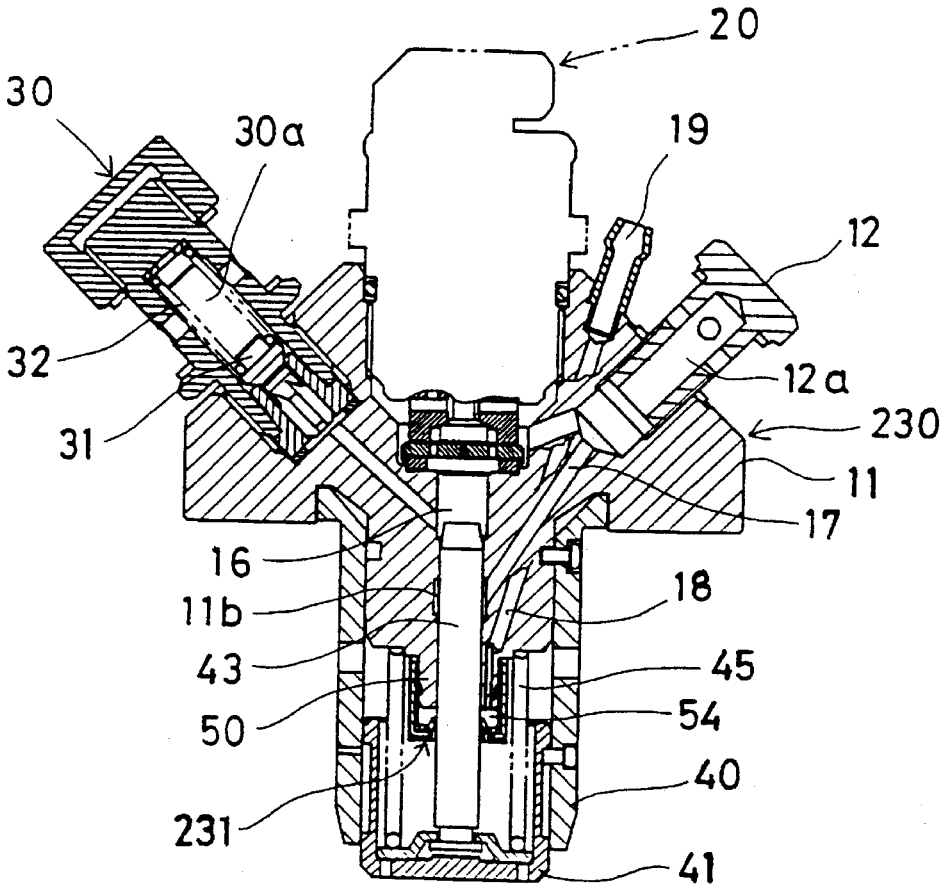
FIG. 22 is a sectional view indicating a pump body according to a twelfth embodiment of the present invention.
Figure 23:
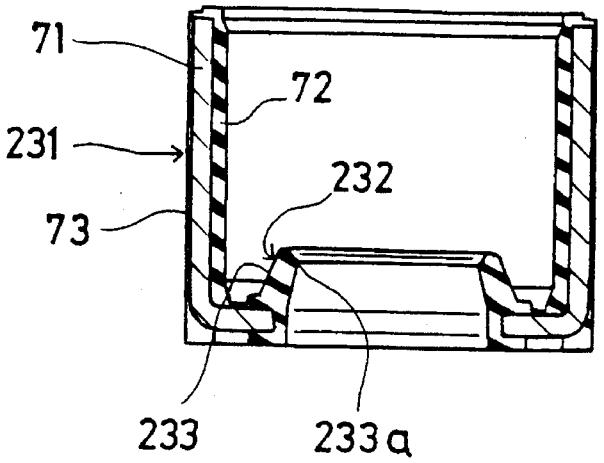
FIG. 23 is a sectional view indicating a seal member according to the twelfth embodiment.

A twelfth embodiment according to the present invention is indicated in FIG. 22 and FIG. 23. In a pump body according to the fourteenth embodiment, only the structure of a seal member 231 differs from the seal member 70 according to the first embodiment; other areas are essentially identical and are indicated by identical symbols.

The seal member 231 is composed of a support member 71, an inner-wall cover portion 72, an outer-wall cover portion 73, and a lip portion 232, and is press-fitted into a protruding portion 50. The support member 71, inner-wall cover portion 72, outer-wall cover portion 73, and lip portion 232 are of rubber fabrication, and are formed integrally.

The lip portion 232 is formed in an annular configuration, and has only an upper lip 233 with an inner diameter which is gradually reduced moving in the direction of lift of a plunger 43. Because of elastic force, the upper lip 233 touches an outer peripheral wall of the plunger 43 with a minimum inner-diameter portion 233*a* formed in an annular configuration on the upper lip 233. Axially before and after wall surfaces of the minimum inner-diameter portion 233*a* form a predetermined angle with the outer peripheral wall of the plunger 43 so that fuel which leaks to a fuel pool 54 from a sliding portion of the plunger 43 and a cylinder 11 further reduces the amount which leaks to a tappet 41 side. For this reason, the upper lip portion 233 cannot adequately reduce the amount of oil which leaks from a sliding portion of the tappet 41 and a tappet guide 40, through a sliding portion of the upper lip 233 and the plunger 43, and into the fuel pool 54. For this reason, oil which has leaked into the fuel pool 54 may leak from the sliding portion of the plunger 43 and cylinder 11 into a fuel pressurization chamber 16, or may be fed from a return passage 18 through the fuel tank and into the fuel pressurization chamber 16. Oil which flows into the fuel pressurization chamber 16 is supplied to the injector together with high-pressure fuel. However, in an engine with a fuel-injection system which does not cause the injector to be exposed directly within the combustion chamber, the injector is not exposed to a high-temperature ambience due to the combustion of fuel, and so it is difficult for oil intermixed in the fuel to be deposited. For this reason, diminishment of the passage sectional surface area of the valve jet can be prevented even if oil is intermixed with the fuel supplied to the injector, and so high-accuracy control of the amount of fuel injection can be maintained. Additionally, because the upper lip 233 has a certain extent of oil-sealing performance, the amount of oil which leaks from the upper lip 233 to the fuel pool 54 is minuscule, and there is no decrease in the overall amount of lubrication oil of the engine or loss of lubrication performance.

By applying a high-pressure fuel-feed pump according to the fourteenth embodiment in an engine with a fuel-injection system which does not cause the injector to be exposed directly within the combustion chamber, only the amount of fuel leakage is favorably reduced by the lip portion 232 having only the upper lip 233, and the amount of oil leakage cannot be adequately reduced, but according to the present invention, by adjusting the angle which the wall surfaces axially before and after the minimum inner-diameter portion formed on the upper lip form with the plunger outer peripheral wall, it is possible to form a lip portion which cannot adequately reduce the amount of fuel leakage but with which the amount of oil leakage is favorably reducible.

(Thirteenth Embodiment)

Figure 24:
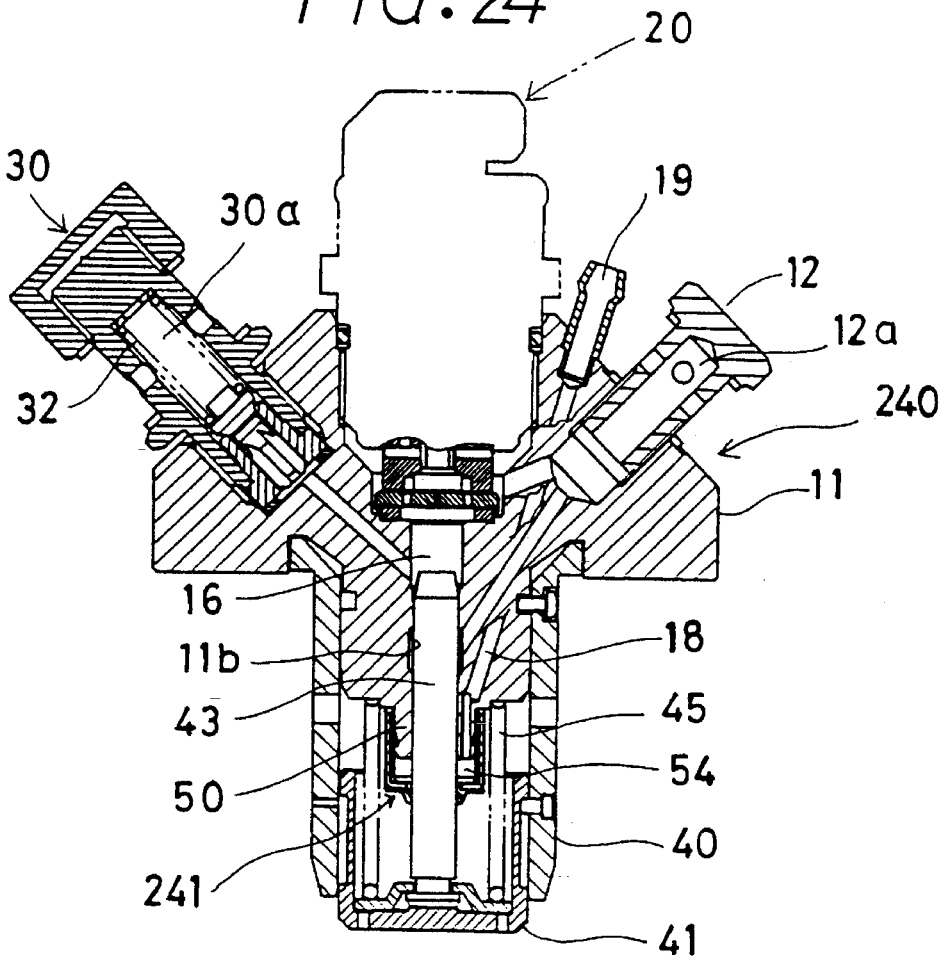
FIG. 24 is a sectional view indicating a pump body according to a thirteenth embodiment of the present invention.
Figure 25:
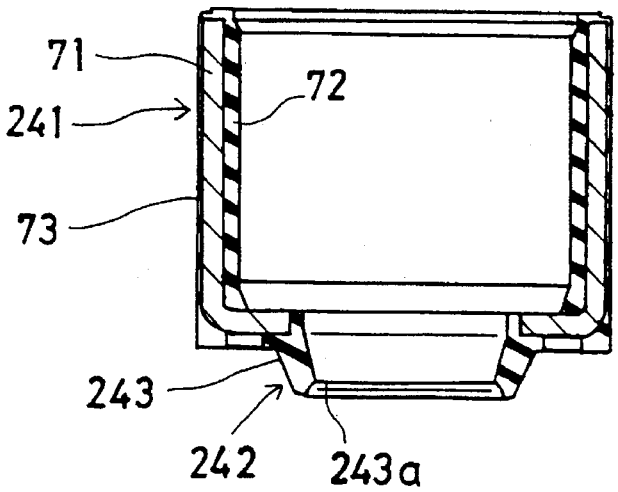
FIG. 25 is a sectional view indicating a seal member according to the thirteenth embodiment.
Figure 26:
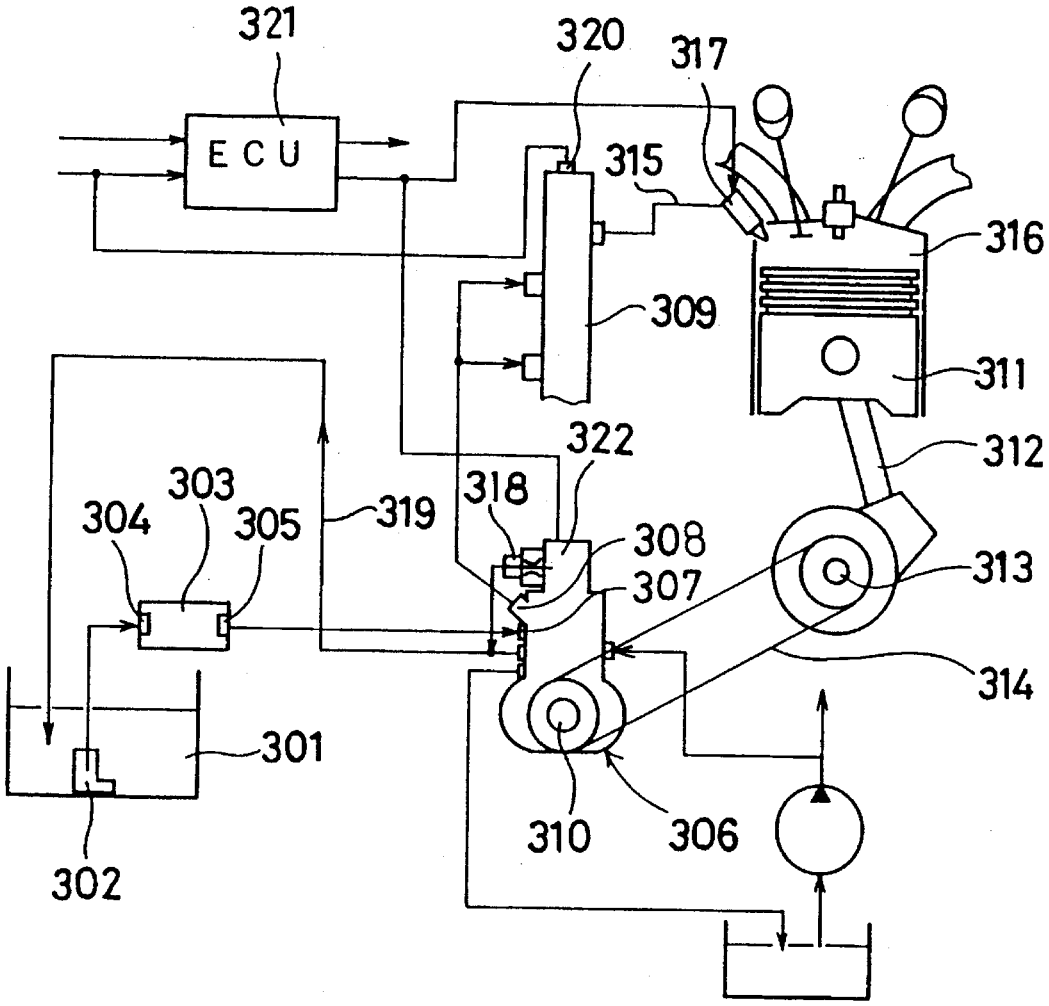
FIG. 26 PRIOR ART
FIG. 26 is a structural diagram indicating a fuel-feed system employing a high-pressure fuel-feed pump according to the related art.

A fifteenth embodiment according to the present invention is indicated in FIG. 24 and FIG. 25. In a pump body according to the fifteenth embodiment, only the orientation of formation of a lip portion 242 of a seal member 241 differs from the seal member 232 according to the fourteenth embodiment; other areas are essentially identical and are indicated by identical symbols.

The lip portion 242 is formed in an annular configuration, and has a lower lip 243 with an inner diameter which is gradually reduced moving in the direction of lowering of a plunger 43. Because of elastic force, the lower lip 243 touches an outer peripheral wall of the plunger 43 with a minimum inner-diameter portion 243*a* formed in an annular configuration on the lower lip 243. Axially before and after wall surfaces of the minimum inner-diameter portion 243*a* form a predetermined angle with the outer peripheral wall of the plunger 43 so that oil which lubricates a sliding portion of the plunger 43 and a cylinder 11 reduces the amount which leaks to from the lip portion 242 to a fuel pool 54, and so the lower lip 243 cannot adequately reduce the amount of fuel which leaks from the fuel pool 54 to a tappet 41 side. However, even if fuel which leaks to the tappet 41 side is intermixed with the oil, fuel intermixed with the oil is volatilized by the surrounding temperature in an ordinary running state of the engine, and so dilution of the oil by fuel which has leaked and decreased lubrication performance can be avoided.

According to the fifteenth embodiment, only the lower lip 243 is formed, and so it is possible to shorten the seal member by an amount corresponding to the axis length of the upper lip according to the first embodiment. For this reason, the overall axis length of the pump body can be shortened.

Additionally, according to the fifteenth embodiment the amount of oil leakage is favorably reduced by the lip portion 242 having only a lower lip 243, and the amount of fuel leakage cannot adequately be reduced, but according to the present invention, by adjusting the angle which the wall surfaces axially before and after the minimum inner-diameter portion formed on the lower lip form with the plunger outer peripheral wall, it is possible to form a lip portion which cannot adequately reduce the amount of oil leakage but with which the amount of fuel leakage is favorably reducible.

According to the above-described embodiments, embodiments applied in a high-pressure fuel-feed pump for gasoline-engine use have been described, but application in a high-pressure fuel-feed pump for diesel-engine use is possible according to the present invention.

Additionally, according to the present embodiments, dislodgement of a seal member has been prevented by 1) press-fitting a seal member into a protruding portion, 2) press-fitting a seal member into a protruding portion together with forming a groove for dislodgement-prevention use on the protruding portion, or 3) providing a flange on a seal member and urging the seal member toward a cylinder by urging force of a compression coil spring, but according to the present invention, it is also possible to fix the seal member to the cylinder with for example a screw or the like.

What is claimed is:

1. A high-pressure fuel-feed pump, comprising:

a cylinder having a bore defined therein and formed to define a fuel pressurization chamber in communication with an intake passage and discharge passage for fuel;

a protruding portion protruding from said cylinder, said bore being defined so as to extend coaxially through said protruding portion;

a plunger supported reciprocatably and slidably by an inner wall that defines said bore;

a discharge-timing control valve for determining discharge timing of fuel pressurized by reciprocating motion of said plunger, the discharge-timing control valve defining pressurizing timing of fuel in the pressurization chamber by closing communication between the pressurization chamber the intake passage; and a seal member for covering said protruding portion from the axial center of said bore and having a hole to receive said plunger and an annular member to liquid-tightly seal an outer peripheral wall of said plunger, wherein an inner wall of said sealing member, an outer peripheral wall of said plunger and a tip end surface of said protruding portion form a fuel pool for pooling fuel.

2. A high-pressure fuel-feed pump according to claim 1, wherein said protruding portion is integrally formed with said cylinder.

3. A high-pressure fuel-feed pump according to claim 2, wherein said plunger reciprocates within a predetermined lift stroke, a straight length between a portion of said plunger contacting with a tip end of said protruding portion and a portion of said plunger contacting with said seal member is longer than said predetermined lift stroke of said plunger.

4. A high-pressure fuel-feed pump according to claim 1, wherein said seal member includes a supporting member made of a metal, a cover portion made of resilient material and lip portion made of resilient material.

5. A high-pressure fuel-feed pump according to claim 1, wherein said seal member is press-fitted into said protruding portion.

6. A high-pressure fuel-feed pump according to claim 1, wherein said protruding portion has a groove at an outer periphery thereof.

7. A high-pressure fuel-feed pump according to claim 1, wherein said protruding portion has a cylindrical shape and said seal member has a tubular shape with an end, said hole is formed in said end of seal member, said hole is covered with a lip portion made of resilient material to seal a clearance between said hole and an outer peripheral wall of said plunger.

8. A high-pressure fuel-feed pump according to claim 1, wherein said plunger reciprocates within a predetermined lift stroke, said hole has a lip portion made of resilient material to seal a clearance between said hole and an outer peripheral wall of said plunger, an axial length of a non-contacting member between an end of said lip portion and an end of said protruding portion is longer than said predetermined lift stroke of said plunger.

9. A high-pressure fuel-feed pump according to claim 1, further comprising:

a guide member disposed on said cylinder;

a driving force transmitting means slidably disposed in said guide member for transmitting a drive force to said plunger;

an urging member for urging said driving force transmitting means to one end, wherein an end surface of said cylinder, said guide member and said driving force transmitting means forms a oil chamber to pool oil for lubricating between said guide member and said driving force transmitting means.

10. A high-pressure fuel-feed pump according to claim 1, wherein said fuel pool is communicated with a return path in communication with a tank having a pressure substantially equal to atmospheric pressure.

11. A high-pressure fuel-feed pump, comprising:

a cylinder having a bore defined therein and formed to define a fuel pressurization chamber in communication with an intake passage and discharge passage for fuel;

a protruding portion protruding from said cylinder, said bore being defined so as to extend coaxially through said protruding portions;

a plunger supported reciprocatably and slidably by an inner wall that defines said bore;

a discharge-timing control valve for determining discharge timing of fuel pressurized by reciprocating motion of said plunger, said discharge-timing control valve defining pressurizing time of the fuel in the pressurization chamber by closing communication between the pressurization chamber and the intake passage;

a seal member having a cap shape with an end to cap said protruding portion from the axial center of said bore and having a hole at said end to receive said plunger, a lip portion disposed around said hole to liquid-tightly seal an outer peripheral wall of said plunger; and a fuel pool formed within an inner wall of said seal member, an outer peripheral wall of said plunger and a tip end surface of said protruding portion for pooling fuel.

12. A high-pressure fuel-feed pump according to claim 11, wherein said fuel pool is communicated with a return path in communication with a tank having a pressure substantially equal to atmospheric pressure.

13. A high-pressure fuel-feed pump, comprising:

a cylinder having a bore defined therein and formed to define a fuel pressurization chamber in communication with an intake passage and discharge passage for fuel;

a protruding portion protruding from said cylinder, said bore being defined so as to extend coaxially through said protruding portion;

a plunger reciprocating in said bore with a predetermined lift stroke, a discharge-timing control valve for determining discharge timing of fuel pressurized by reciprocating motion of said plunger, said discharge timing control valve defining pressurizing time of the fuel in the pressurization chamber by closing communication between pressurizing chamber and the intake passage; and a seal member capping said protruding portion from the axial center of said bore and having a hole to receive said plunger and a lip portion made of resilient material to seal an clearance between said hole and an outer peripheral wall of said plunger;

wherein a straight length between a portion of said plunger contacting said lip portion and an end surface of said protruding portion is longer than said predetermined lift stroke of said plunger.

14. A high-pressure fuel-feed pump, comprising a cylinder having a bore defined therein and formed to define a fuel pressurization chamber in communication with an intake passage and discharge passage for fuel;

a plunger supported reciprocatably and slidably by an inner wall that defines said bore;

a discharge-timing control valve for determining discharge timing of fuel pressurized by reciprocating motion of said plunger, the discharge timing control valve defining the pressurization and timing of fuel in the pressurization chamber by closing communication between the pressurization chamber and the intake passage; and a seal member disposed at a lower position of said bore and having a hole to receive said plunger and an annular member to liquid-tightly seal an outer peripheral wall of said plunger, wherein an inner wall of said seal member and an outer peripheral wall of said plunger form a fuel pool for pooling fuel.

* * * * *